US010096908B2

(12) United States Patent
Jan et al.

(10) Patent No.: US 10,096,908 B2
(45) Date of Patent: Oct. 9, 2018

(54) ANTENNA DEVICE

(71) Applicant: Wistron NeWeb Corporation, Hsinchu (TW)

(72) Inventors: Cheng-Geng Jan, Hsinchu (TW); Tsun-Che Huang, Hsinchu (TW); An-Shyi Liu, Hsinchu (TW); Chi-Kang Su, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 189 days.

(21) Appl. No.: 15/045,274

(22) Filed: Feb. 17, 2016

(65) Prior Publication Data

US 2016/0301136 A1 Oct. 13, 2016

Related U.S. Application Data

(60) Provisional application No. 62/143,820, filed on Apr. 7, 2015.

(30) Foreign Application Priority Data

Jun. 29, 2015 (TW) ..... 104120869 A

(51) Int. Cl.
*H01Q 21/24* (2006.01)
*H01Q 9/28* (2006.01)
(Continued)

(52) U.S. Cl.
CPC ..... *H01Q 21/24* (2013.01); *H01Q 5/371* (2015.01); *H01Q 9/0414* (2013.01); *H01Q 9/16* (2013.01);
(Continued)

(58) Field of Classification Search
CPC ..... H01Q 5/48; H01Q 5/371; H01Q 9/065; H01Q 19/10; H01Q 21/24; H01Q 1/38; H01Q 19/108; H01Q 19/185; H01Q 21/26
See application file for complete search history.

(56) References Cited

U.S. PATENT DOCUMENTS 6,342,867 B1 * 1/2002 Bell ..... H01Q 19/108 343/795
2007/0046558 A1 * 3/2007 Tillery ..... H01Q 1/246 343/797
(Continued)

FOREIGN PATENT DOCUMENTS

CN 1432206 A 7/2003
CN 102025030 A 4/2011
CN 103794883 A 5/2014

*Primary Examiner* — Dameon E Levi
*Assistant Examiner* — Ricardo Magallanes
(74) *Attorney, Agent, or Firm* — Winston Hsu

(57) ABSTRACT

An antenna device includes a dual-band cross dipole antenna including four radiators each extending from an axis toward a plane and including a first radiating element and a second radiating element for transmitting or receiving radio signals of a first band and a second band, wherein a plane where each radiator is located is perpendicular to a plane where a neighboring radiator is located; and a reflecting board disposed on a side of the dual-band cross dipole antenna, wherein a location and a shape of the reflecting board relate to wavelengths corresponding to signals of the first band and the second band, such that the dual-band cross dipole antenna is directional in the first band and omnidirectional in the second band.

9 Claims, 29 Drawing Sheets

(51) Int. Cl.

| | |
|---|---|
| ***H01Q 5/371*** | (2015.01) |
| ***H01Q 19/10*** | (2006.01) |
| ***H01Q 21/30*** | (2006.01) |
| ***H01Q 9/16*** | (2006.01) |
| ***H01Q 9/04*** | (2006.01) |
| *H01Q 9/06* | (2006.01) |

(52) U.S. Cl.
CPC ..... *H01Q 9/28* (2013.01); *H01Q 21/30* (2013.01); *H01Q 9/065* (2013.01); *H01Q 9/285* (2013.01); *H01Q 19/108* (2013.01)

(56) References Cited

U.S. PATENT DOCUMENTS

2007/0146225 A1* 6/2007 Boss ..... H01Q 21/08 343/797
2012/0293377 A1* 11/2012 Liang ..... H01Q 9/065 343/702
2014/0191919 A1* 7/2014 Hsu ..... H01Q 9/0414 343/837

* cited by examiner

ANTENNA DEVICE

CROSS REFERENCE TO RELATED APPLICATIONS

This application claims the priority of U.S. Provisional Application No. 62/143,820, filed Apr. 7, 2015, which is included herein by reference.

BACKGROUND OF THE INVENTION

1. Field of the Invention

The present invention relates to an antenna device, and more particularly, to an antenna device capable of performing dual-band operation and substantially being directional in a high-frequency band and omnidirectional in a low-frequency band.

2. Description of the Prior Art

As the communication techniques progress, many wireless communication systems support dual-band operations. To achieve the dual-band operation, the prior art have to respectively manufacture antennas for high/low-frequency operations, and combine the antennas with a duplexer as an antenna device. However, the gain of the antenna device reduces dramatically and has reliability issues if the antenna device is minimized.

In addition, the antenna device may need to timely adjust an antenna angle or directional position in some applications, which may result in signal dead zones during the adjustment. For example, indoor customer premises equipments are utilized to provide indoor wireless communication services. Since indoor partitions and furniture placements may affect the propagation of wireless electric waves, the prior art has provided an antenna device capable of automatically adjusting the antenna angle or directional position, such that the indoor customer premises equipments may adjust transmitting and receiving conditions of wireless signals according to distribution of indoor users. However, when the antenna device is adjusting the antenna angle or directional position, signal dead zones may occur, which affects utilization and causes inconvenience if there are users in the signal dead zones, or the adjustment is too slow.

Therefore, how to improve a gain of a minimized dual-band antenna and how to avoid the signal dead zone of the antenna device capable of adjusting the antenna angle or directional position during the adjustment have become critical issues in the field.

SUMMARY OF THE INVENTION

It is therefore a primary objective of the present invention to provide an antenna device so as to improve disadvantages of the prior art.

An embodiment of the present invention discloses an antenna device, comprising a dual-band crossed-dipole antenna, comprising four radiators each extending from an axis toward a plane and comprising a first radiating element and a second radiating element for respectively transmitting or receiving radio signals of a first band and a second band, wherein a plane where each radiator is located is perpendicular to a plane where a neighboring radiator is located; and a reflecting board, disposed on a side of the dual-band crossed-dipole antenna; wherein a first projection result generated by projecting the reflecting board along the central axis on the reference plane is substantially a square, and a second projection result generated by projecting the dual-band crossed-dipole antenna along the central axis on the reference plane is substantially corresponding to two diagonals of the square, wherein the reference plane is perpendicular to the central axis; wherein a center frequency of the first band is higher than a center frequency of the second band, a diagonal length of the square of the first projection result is greater than 0.6 times of a signal wavelength corresponding to the first band and smaller than 0.35 times of a signal wavelength corresponding to the second band, and a nearest distance between the reflecting board and any first radiating element of the four radiators is between 0.15 to 0.25 times of the signal wavelength corresponding to the first band, such that the dual-band crossed-dipole antenna is substantially directional in the first band and omnidirectional in the second band.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
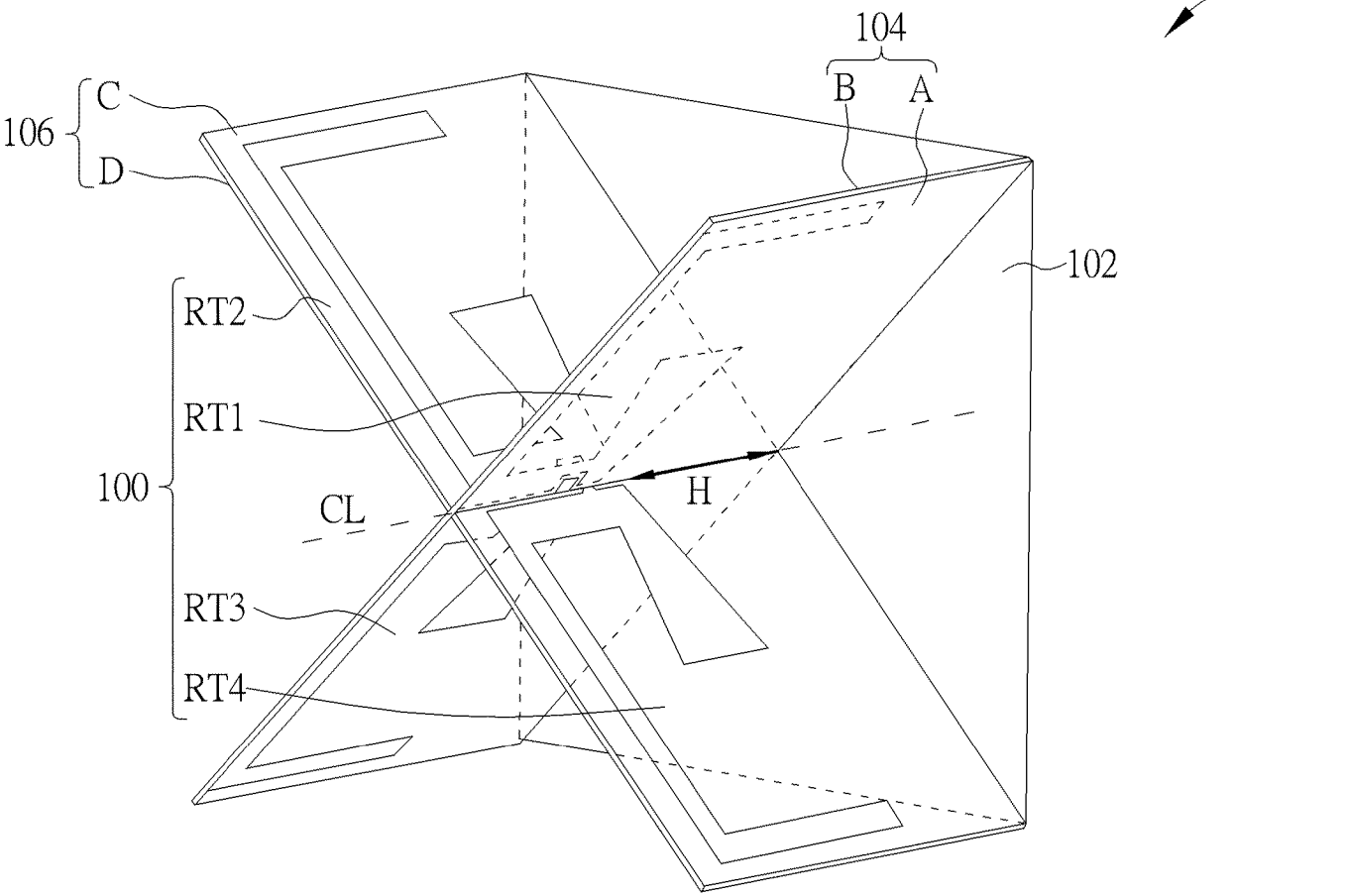
FIG. 1 is a schematic diagram of an antenna device according to an embodiment of the present invention.
Figures 2A, 2B, 2C:
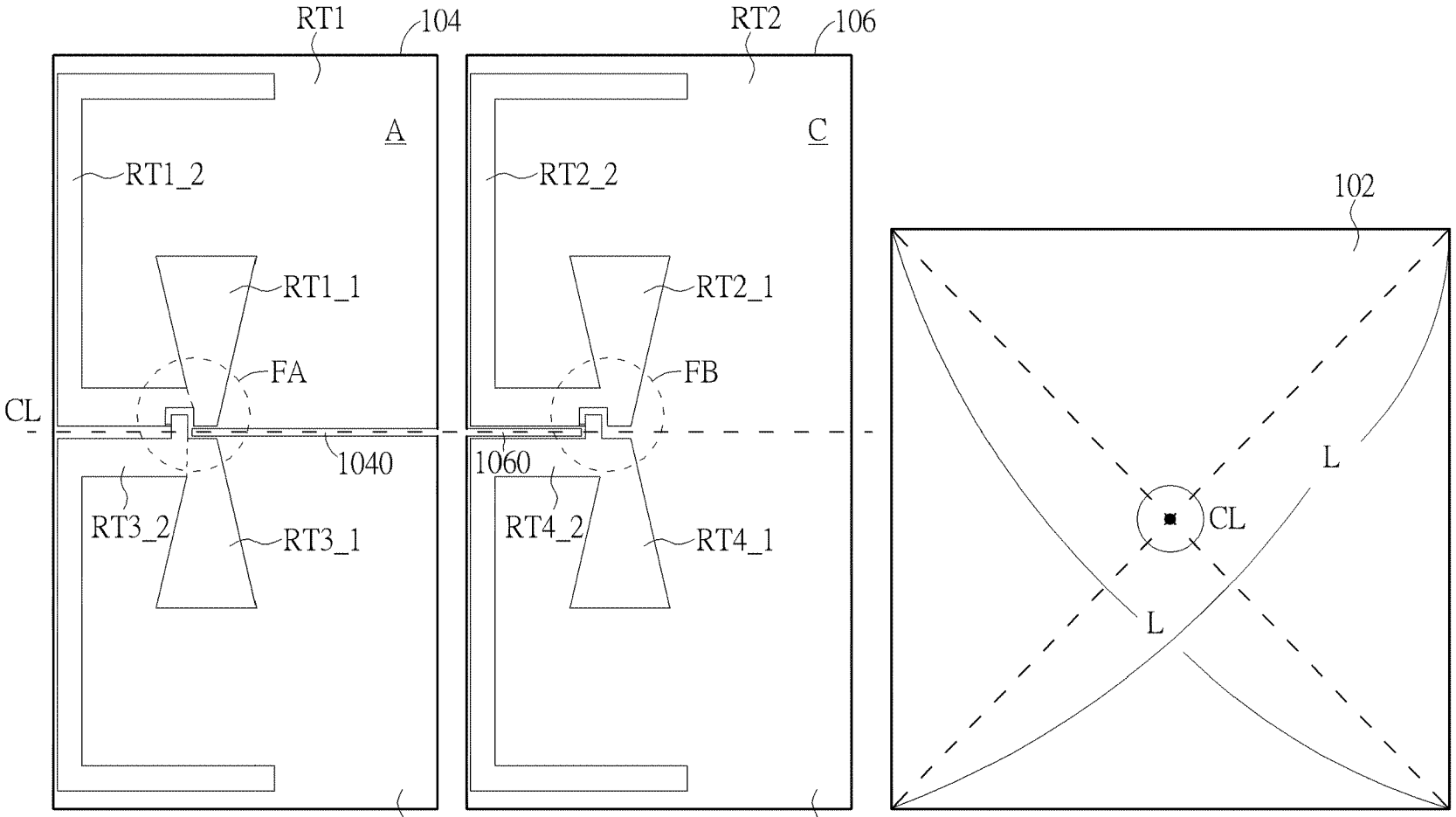
FIGS. 2A to 2C are schematic diagrams of components of the antenna device shown in FIG. 1.

FIG. 1 is a schematic diagram of an antenna device 10 according to an embodiment of the present invention, and FIGS. 2A to 2C are schematic diagrams of components of the antenna device 10. The antenna device 10 comprises a dual-band crossed-dipole antenna 100 and a reflecting board 102, and is capable of performing dual-band operation, wherein the dual-band operation may involve a first band and a second band, and a center frequency of the first band is higher than that of the second band. And, the antenna device 10 is substantially directional in a high-frequency band (i.e. the first band) and omnidirectional in a low-frequency band (i.e. the second band). The dual-band crossed-dipole antenna 100, as literally implied, has two dipole antennas crossly disposed. More specifically, the dual-band crossed-dipole antenna 100 includes radiators RT1-RT4, each of the radiators RT1-RT4 extends from an axis CL toward a plane, the planes where two neighboring radiators are located are perpendicular to each other, i.e., the radiator RT1 is perpendicular to the radiators RT2 and RT4, the radiator RT2 is perpendicular to the radiators RT1 and RT3, and so on. Thus, the radiators RT1 and RT3 form a first dipole antenna, and the radiators RT2 and RT4 form a second dipole antenna, wherein the two dipole antennas are respectively (+45°) and (−45°) polarized and are therefore orthogonal, so as to enhance isolation. Furthermore, the radiators RT1-RT4 respectively includes two radiating elements, say RT1_1, RT1_2, RT2_1, RT2_2, RT3_1, RT3_2, RT4_1 and RT4_2. Due to different lengths, the radiating elements RT1_1, RT2_1, RT3_1 and RT4_1 receive and transmit wireless signals of the high-frequency band and each have a shape similar to a trapezoid or a bow tie, and the radiating elements RT1_2, RT2_2, RT3_2 and RT4_2 receive and transmit wireless signals of the low-frequency band and each have a shape similar to a stripe which contains two (90 degrees) bendings. Moreover, in this embodiment, the radiators RT1 and RT3 are disposed on an "A" side of a base plate 104 (for clarity, the other side thereof is marked as a "B" side), and the radiators RT2 and RT4 are disposed on a "C" side of a base plate 106 (for clarity, the other side thereof is marked as a "D" side), but not limited thereto. Dual-band crossed-dipole antennas that may extend from the central axis CL toward four perpendicular directions are suitable for the present invention. In other words, as long as relative positions of the radiators RT1-RT4 can be adequately fixed, the radiators RT1-RT4 may be implemented in other ways, which is not limited to being disposed on the base plates 104 and 106. Meanwhile, slots 1040 and 1060 are formed in the base plates 104 and 106, which is to fit assembly requirement, and may be adjusted adequately. In addition, shapes of feed-in points of the radiators RT1-RT4 are different, as shown in a region FA of FIG. 2A and a region FB of FIG. 2B, which is also to fit assembly requirement, and may be adjusted adequately. In other words, shapes of the radiators RT1-RT4 may be identical or different, which is not limited thereto. For example, as long as each electric current path of the radiating elements RT1_1, RT2_1, RT3_1 and RT4_1 satisfies a quarter wavelength of the wireless signal to be transmitted or received, shapes of the radiating elements RT1_1, RT2_1, RT3_1 and RT4_1 are not limited to trapezoids or bow ties. Similarly, as long as each electric current paths of the radiating elements RT1_2, RT2_2, RT3_2 and RT4_2 satisfies a quarter wavelength of the wireless signal to be transmitted or received, shapes of the radiating elements RT1_2, RT2_2, RT3_2 and RT4_2 are not limited to stripes with two bendings.

Moreover, the reflecting board 102 is made of a metal material, and is disposed on a side of the dual-band crossed-dipole antenna 100. In this embodiment, the reflecting board 102 is square, and the base plates 104 and 106 are perpendicular to the reflecting board 102 and substantially overlap with diagonals of the reflecting board 102. In other words, taking the reflecting board 102 as a reference plane, a projection result generated by projecting the dual-band crossed-dipole antenna 100 along the central axis CL on the reflecting board 102 is substantially corresponding to the diagonals of the reflecting board 102.

In order to have the dual-band crossed-dipole antenna 100 substantially directional in the high-frequency band and omnidirectional in the low-frequency band, the embodiment of the present invention controls a size of the reflecting board 102 and a relative position between the reflecting board 102 and the dual-band crossed-dipole antenna 100. More specifically, a diagonal length L of the reflecting board 102 has to be greater than 0.6 times of the signal wavelength corresponding to the high-frequency band and smaller than 0.35 times of the signal wavelength corresponding to the low-frequency band, and a nearest distance H between the reflecting board 102 and the high-frequency radiating elements RT1_1, RT2_1, RT3_1 and RT4_1 of the radiators RT1-RT4 is between 0.15 to 0.25 times of the signal wavelength corresponding to the high-frequency band. By doing so, the dual-band crossed-dipole antenna 100 is substantially directional in the high-frequency band and omnidirectional in the low-frequency band, which can be proved by simulation results.

Figure 3A:
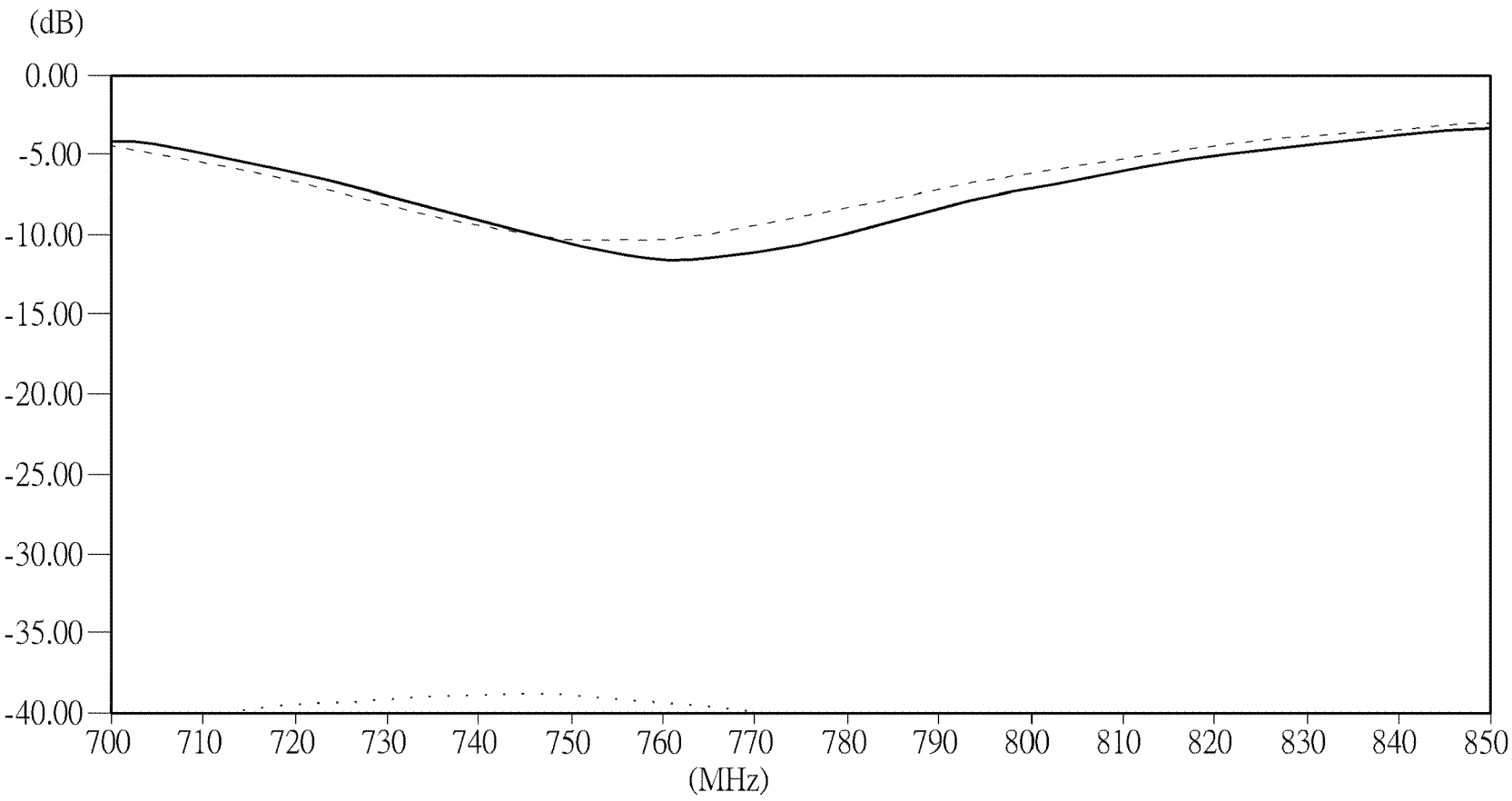
FIGS. 3A and 3B are schematic diagrams of the S-parameters of the antenna device operating in different bands shown in FIG. 1.
Figure 3B:
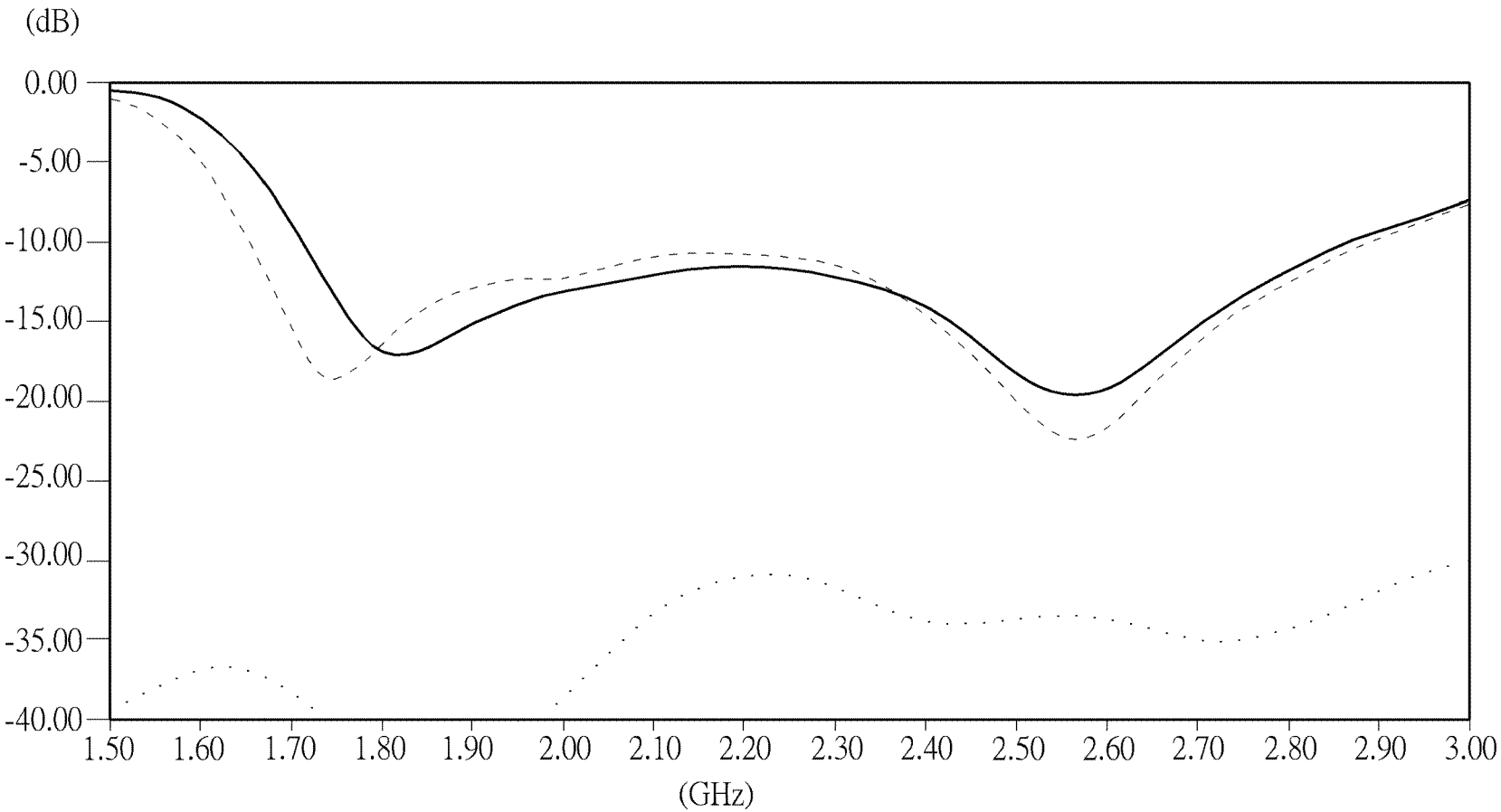

For example, Long Term Evolution (LTE) wireless communication system has designated a plurality of operating bands, where Band4 refers to 1710 MHz-1755 MHz and 2110 MHz-2155 MHz, and Band13 refers to 777 MHz-787 MHz and 746 MHz-756 MHz. In such a situation, by adequately adjusting the lengths of the radiating elements RT1_1, RT2_1, RT3_1 and RT4_1 to receive and transmit the wireless signal of Band4, adjusting the lengths of the radiating elements of RT1_2, RT2_2, RT3_2 and RT4_2 to receive and transmit the wireless signal of Band4, configuring the diagonal length L of the reflecting board 102 to be between 0.6 times (about 75 mm) of the signal wavelength corresponding to 1710 MHz and 0.35 times (about 94 mm) of the signal wavelength corresponding to 787 MHz, and configuring the nearest distance H between the reflecting board 102 and the radiating elements RT1_1, RT2_1, RT3_1 and RT4_1 to be between 0.15 times (about 18.75 mm) and 0.25 times (about 31.25 mm) of the signal wavelength corresponding to the 1710 MHz, the dual-band crossed-dipole antenna 100 is substantially directional in Band4 and omnidirectional in Band13, and related simulation results are shown in FIGS. 3A to 3F. FIGS. 3A and 3B are schematic diagrams of S-parameters of the antenna device 10 operating in Band13 and Band4, wherein a solid-line curve represents the simulation result of the return loss (S11) of the first dipole antenna formed by the radiators RT1 and RT3, a dashed-line curve represents the simulation result of the return loss (S22) of the second dipole antenna formed by the radiators RT2 and RT4, and a dotted-line curve represents the simulation result of the transmission coefficient (S21, representing isolation) of the first dipole antenna relative to the second dipole antenna. As can be seen from FIGS. 3A and 3B, the antenna device 10 can accurately operate in Band13 and Band4, and isolation between the first dipole antenna and the second dipole antenna exceeds 30 dB, to ensure normal operations of the first dipole antenna and the second dipole antenna.

Figure 3C:
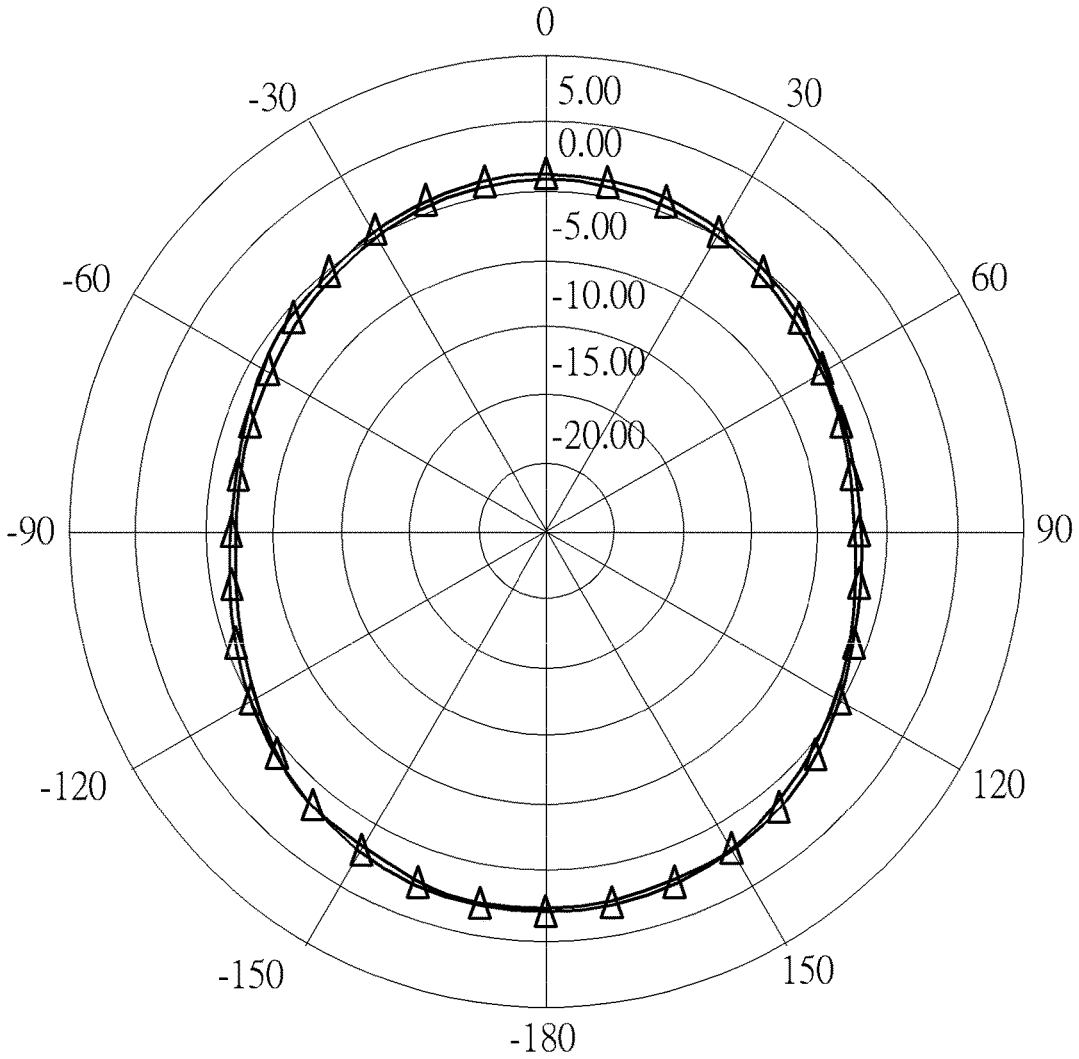
FIGS. 3C to 3F are pattern simulation results of the antenna device operating in different bands shown in FIG. 1.
Figure 3D:
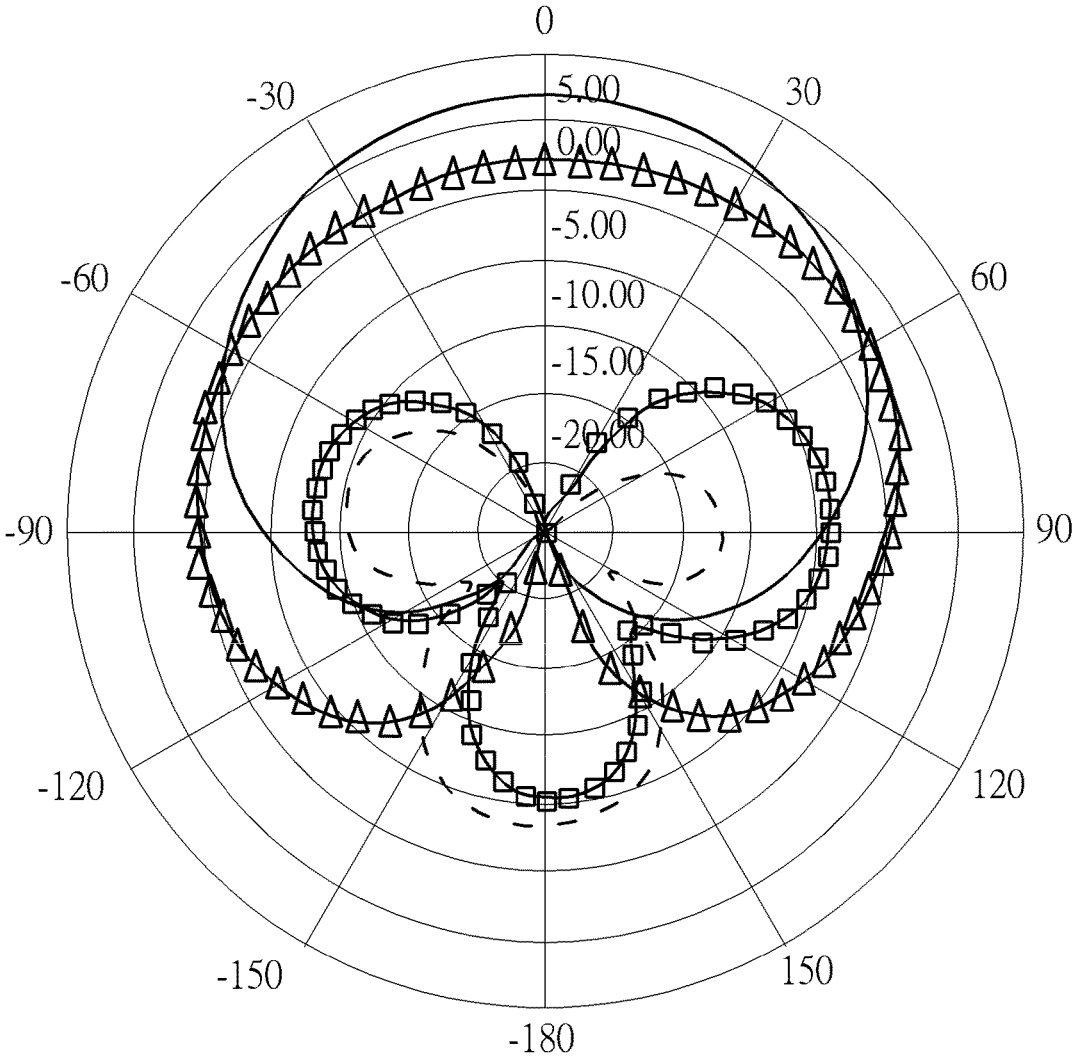
Figure 3E:
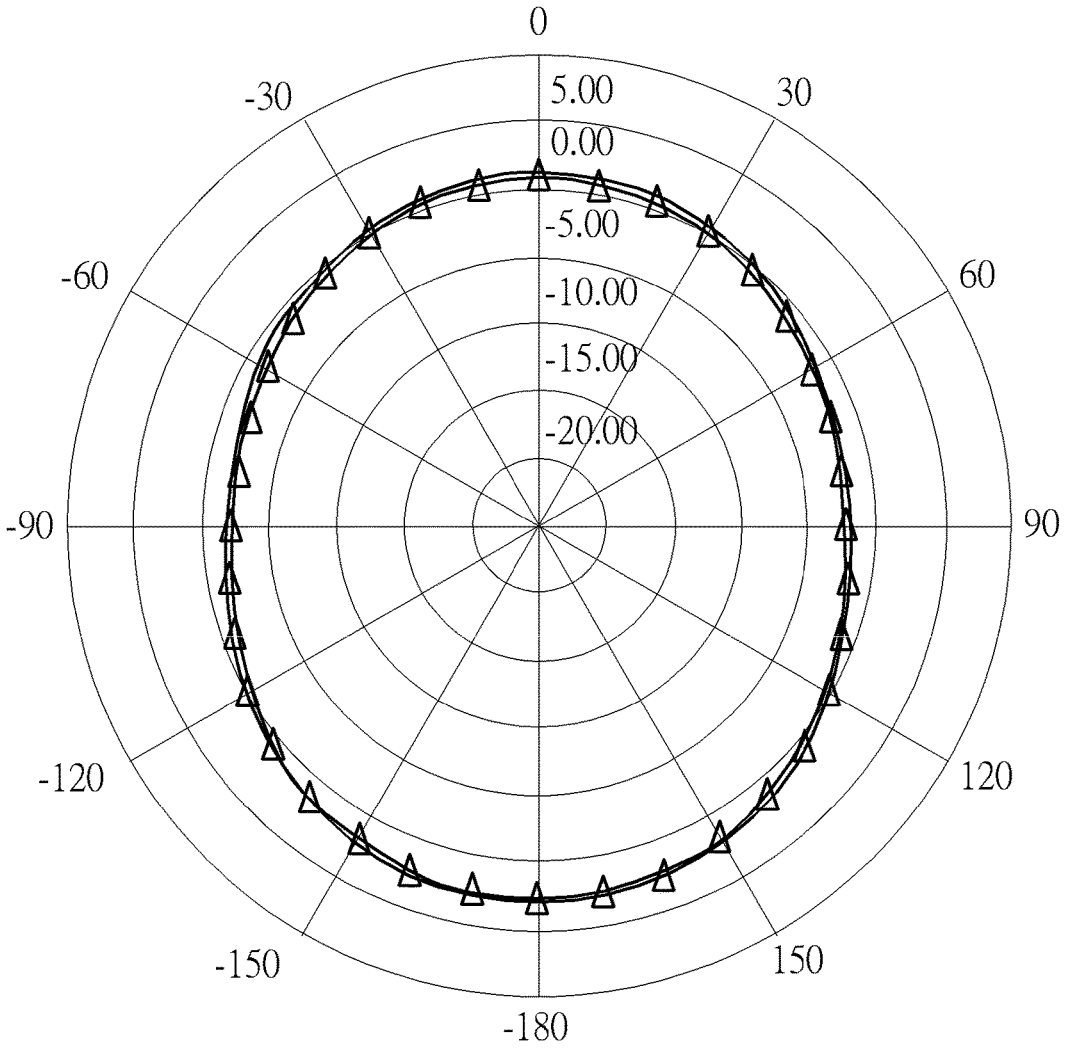
Figure 3F:
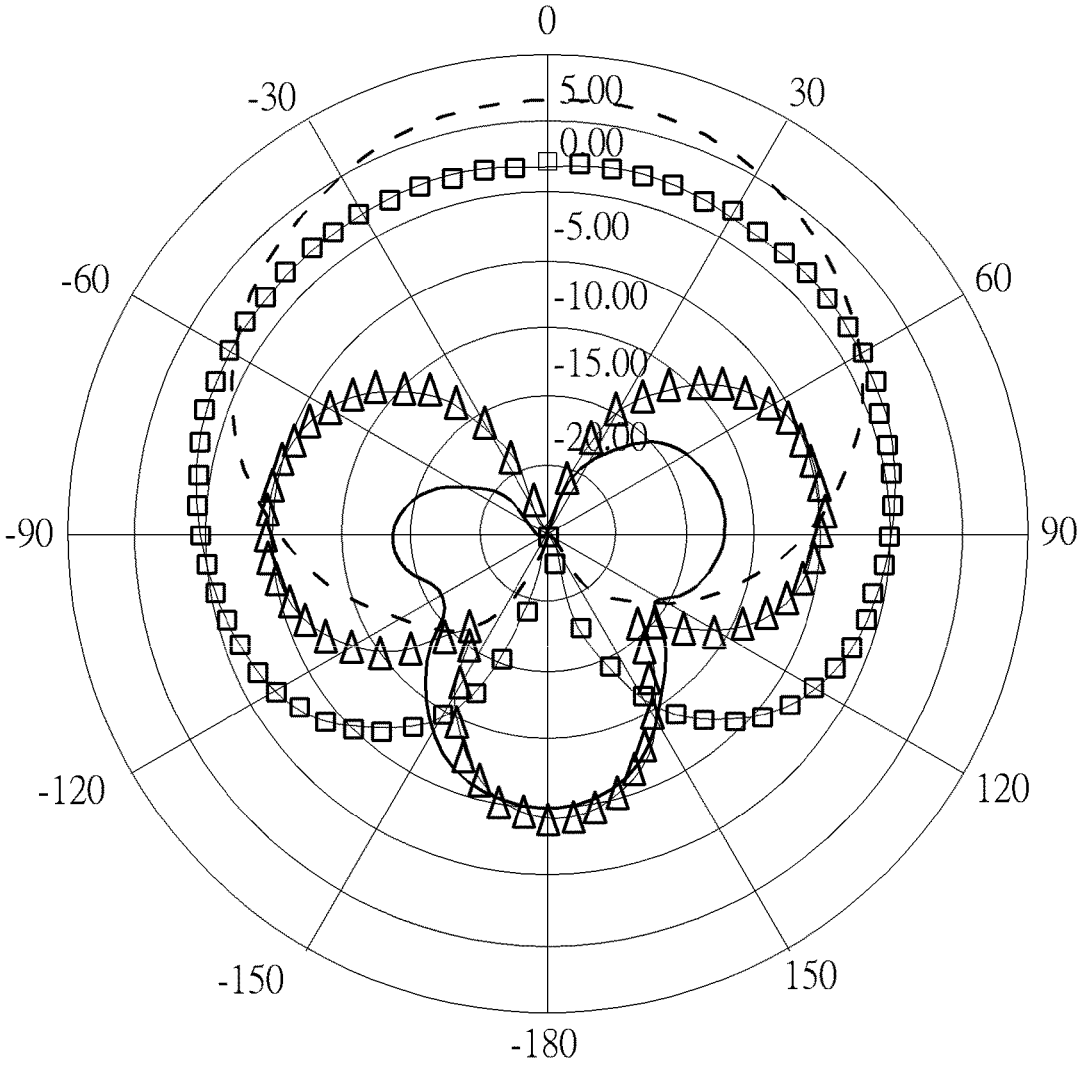

Moreover, FIGS. 3C and 3D are pattern simulation results of the first dipole antenna operating in Band13 and Band4, and FIGS. 3E and 3F are pattern simulation results of the second dipole antenna operating in Band13 and Band4. In FIG. 3C, a solid-line curve represents the pattern of the first dipole antenna operating at 750 MHz in Band13, and a triangle-line curve represents the pattern of the first dipole antenna operating at 780 MHz in Band13. In FIG. 3D, a solid-line curve represents the Co-polarization pattern of the first dipole antenna operating at 1740 MHz in Band4, and a triangle-line curve represents the Co-polarization pattern of the first dipole antenna operating at 2140 MHz in Band4, a dashed-line curve represents the Cross-polarization pattern of the first dipole antenna operating at 1740 MHz in Band4, a square-line curve represents the Cross-polarization pattern of the first dipole antenna operating at 2140 MHz in Band4. Similarly, in FIG. 3E, a solid-line curve represents the pattern of the second dipole antenna operating at 750 MHz in Band13, and a triangle-line curve represents the pattern of the second dipole antenna operating at 780 MHz in Band13. In FIG. 3F, a dashed-line curve represents the Co-polarization pattern of the second dipole antenna operating at 1740 MHz in Band4, a square-line curve represents the Co-polarization pattern of the second dipole antenna operating at 2140 MHz in Band4, a solid-line curve represents the Cross-polarization pattern of the second dipole antenna operating at 1740 MHz in Band4, and a triangle-line curve represents the Cross-polarization pattern of the second dipole antenna operating at 2140 MHz in Band4.

As shown in FIGS. 3C to 3F, the first crossed-dipole antenna and the second crossed-dipole antenna are substantially omnidirectional in Band13 and directional in Band4. Hence, by adequately adjusting the size and position of the reflecting board 102, the antenna device 10 accurately operates in the high-frequency and low-frequency bands, and is substantially directional in the high-frequency band (i.e. Band4) and substantially omnidirectional in the low-frequency band (i.e. Band13). In such a situation, the embodiment of the present invention does not need duplexer, but achieves an antenna device capable of operating in the high/low-frequency bands. More importantly, for applications which require to timely adjust the antenna angle or the directing position, such as indoor customer premises equipments, the antenna device 10 of the present invention, if applied, can reduce and avoid the occurrences of dead zones and maintain the utilization of wireless transmission during the adjustment of the antenna angle or the directing position, because the antenna device 10 is omnidirectional in the low-frequency band.

Figure 4:
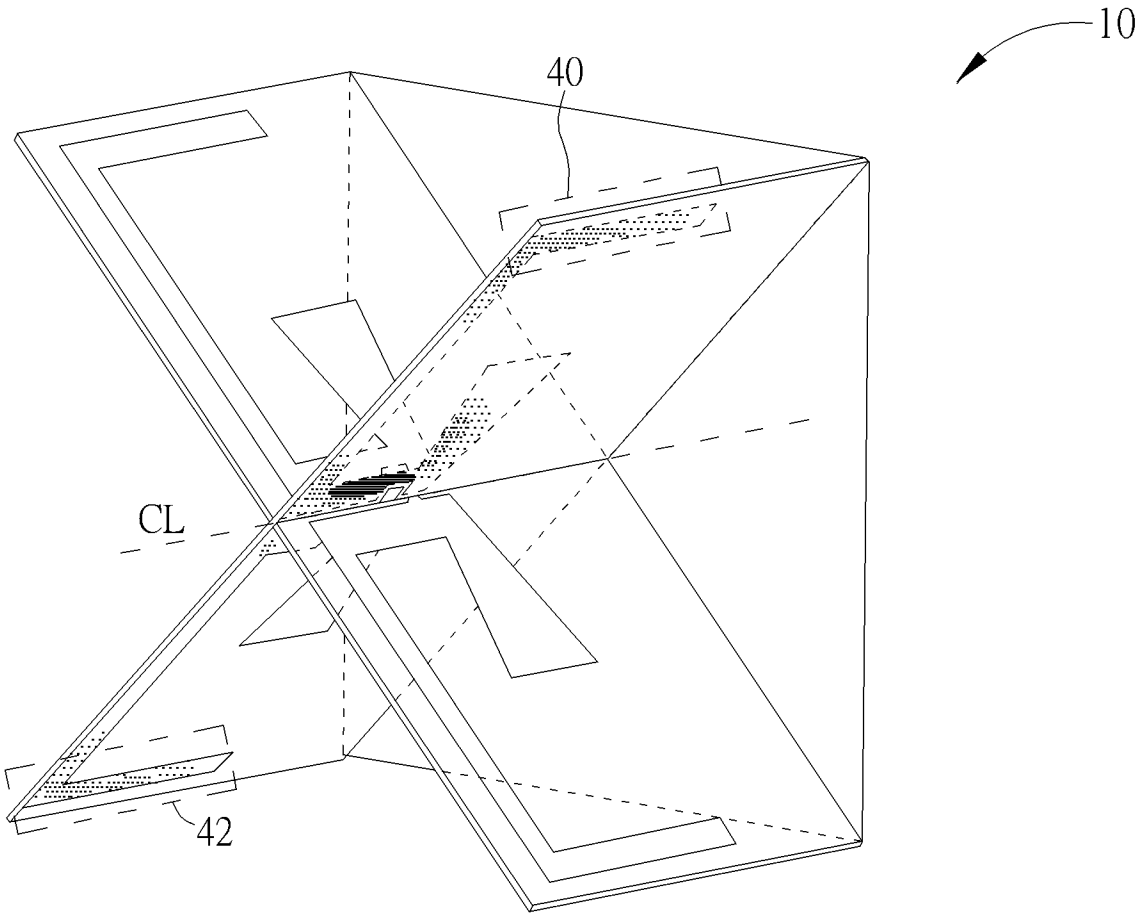
FIG. 4 is a schematic diagram of the electric current distribution of the antenna device shown in FIG. 1.

Notably, the antenna device 10 is an embodiment of the present invention, and those skilled in the art may make modifications and alterations accordingly. For example, as mentioned in the above, shapes and ways of assembly of the radiators RT1-RT4 of the dual-band crossed-dipole antenna 100 may be adequately adjusted, and not limited to examples shown in FIG. 1 and FIGS. 2A to 2C. For example, as shown in FIGS. 3C and 3E, the dual-band crossed-dipole antenna 100 has a gain drift around 5.2 dB in the low-frequency band, because the first dipole antenna and the second dipole antenna respectively incline with 45°, causing energy at the left edge and right edge of the pattern to slightly decrease. In addition, as shown in FIGS. 3D and 3F, the antenna gains of the first dipole antenna and the second dipole antenna are around 6.9 dBi within the range between 1710 MHz and 1755 MHz (i.e. the uplink band of Band4), while the antenna peak gain is relatively low within the range between 2110 MHz and 2155 MHz (i.e. the downlink band of Band4), where the front gain is only 2.5 dBi. This is because partial electric current flows to the low-frequency radiating elements, i.e. RT1_2, RT2_2, RT3_2 and RT4_2, and reduces the gain. FIG. 4 is a schematic diagram of electric current distribution of the antenna device 10 shown in FIG. 1 operating at 2140 MHz. For simplicity, the notations of the antenna device 10 in FIG. 4 are omitted, and can be realized by referring to FIG. 1 and FIGS. 2A to 2C. As can be seen from regions 40 and 42 shown in FIG. 4, when operating in the high-frequency band, the low-frequency radiating elements of the antenna device 10 (i.e. the radiating elements RT1_2 and RT3_2 as known by referring to FIGS. 1 and 2A to 2C) has strong electric current, which results in distraction of the high-frequency pattern to both lateral sides and decrease of the gain.

Figure 5A:
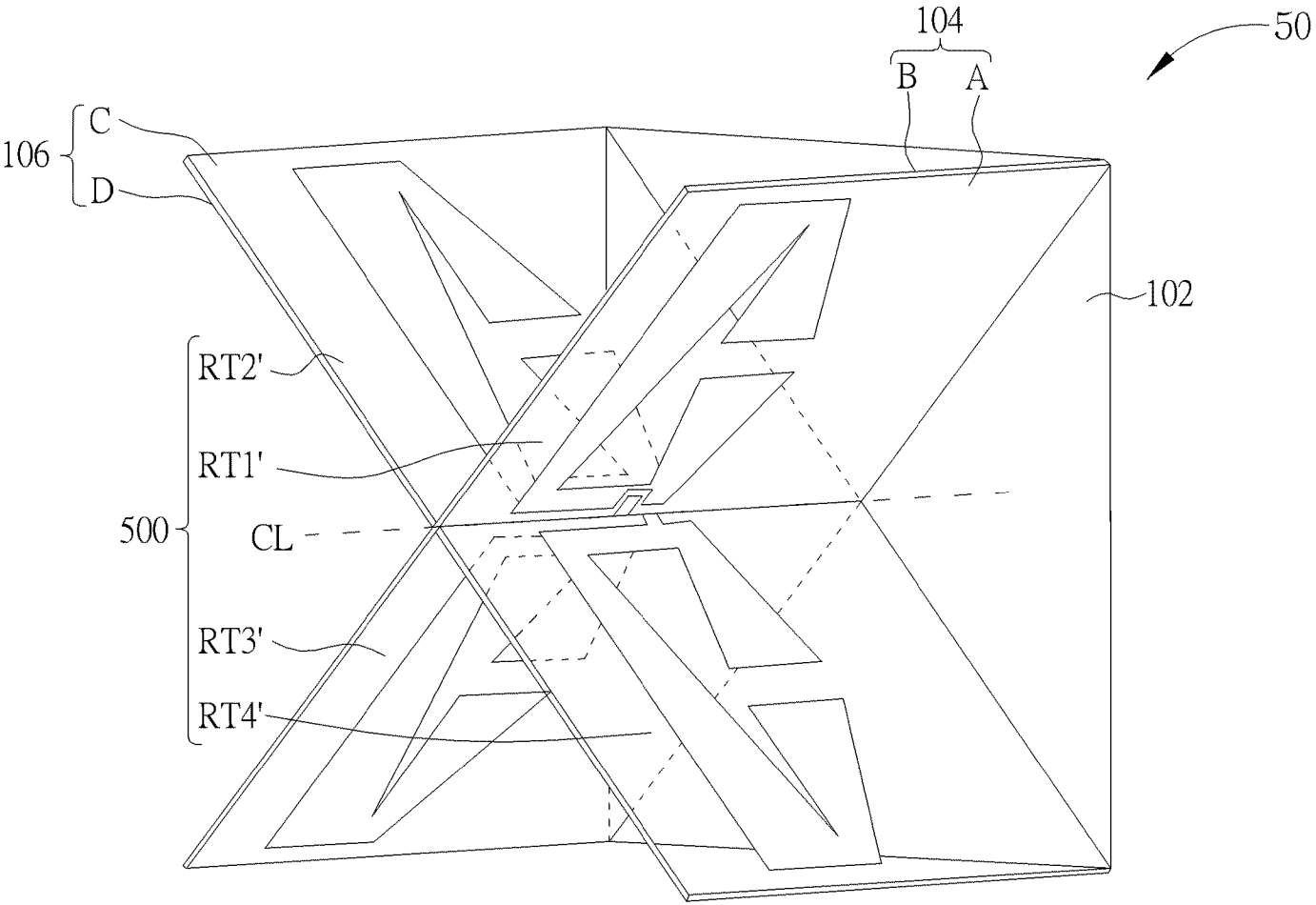
FIG. 5A is a schematic diagram of an antenna device according to an embodiment of the present invention.
Figure 5B:
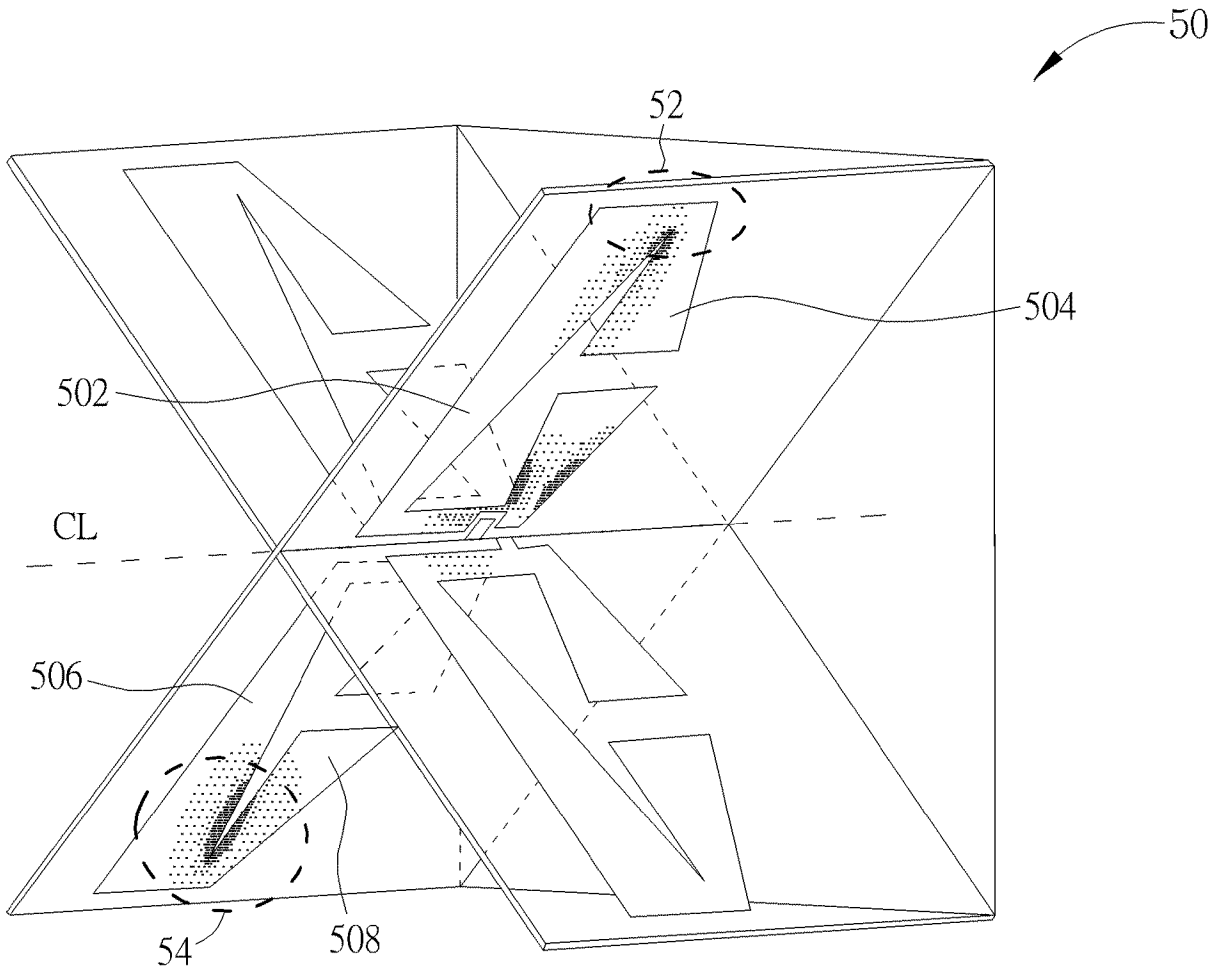
FIG. 5B is a schematic diagram of the electric current distribution of the antenna device shown in FIG. 5A.

FIG. 5A is a schematic diagram of an antenna device 50 according to an embodiment of the present invention. The antenna device 50 is derived from the antenna device 10, and the same components use the same notations. Different from the antenna device 10, the radiators RT1-RT4 of the antenna 10 are replaced by the radiators RT1'-RT4' to form a dual-band crossed-dipole antenna 500 in the antenna 50. In addition, the antenna device 50 similarly can perform the dual-band operation (e.g. operations in a first band and a second band), and is substantially directional in the high-frequency band (i.e. the first band) and substantially omnidirectional in the low-frequency band (i.e. the second band). The radiators RT1'-RT4' may effectively reduce the lateral current on the low-frequency radiating elements when operating in the high-frequency band. FIG. 5B. FIG. 5B is a schematic diagram of electric current distribution of the antenna device 50 operating at 2140 MHz. As can be seen from FIG. 5B, lateral currents on the low-frequency radiating elements of the radiators RT1'-RT4' almost vanish, and thus, the high-frequency gain is improved. In detail, the lengths of the radiators RT1'-RT4' still meet the requirements of the radiators RT1-RT4, while the main difference therebetween rely on bending methods of the low-frequency radiators, i.e. regions 52 and 54, and width variations of partial segments, i.e. 502, 504, 506 and 508, which make currents on the lateral regions, i.e. the regions 52 and 54, reduce to almost zero, so as to enhance the high-frequency gain.

Figure 6A:
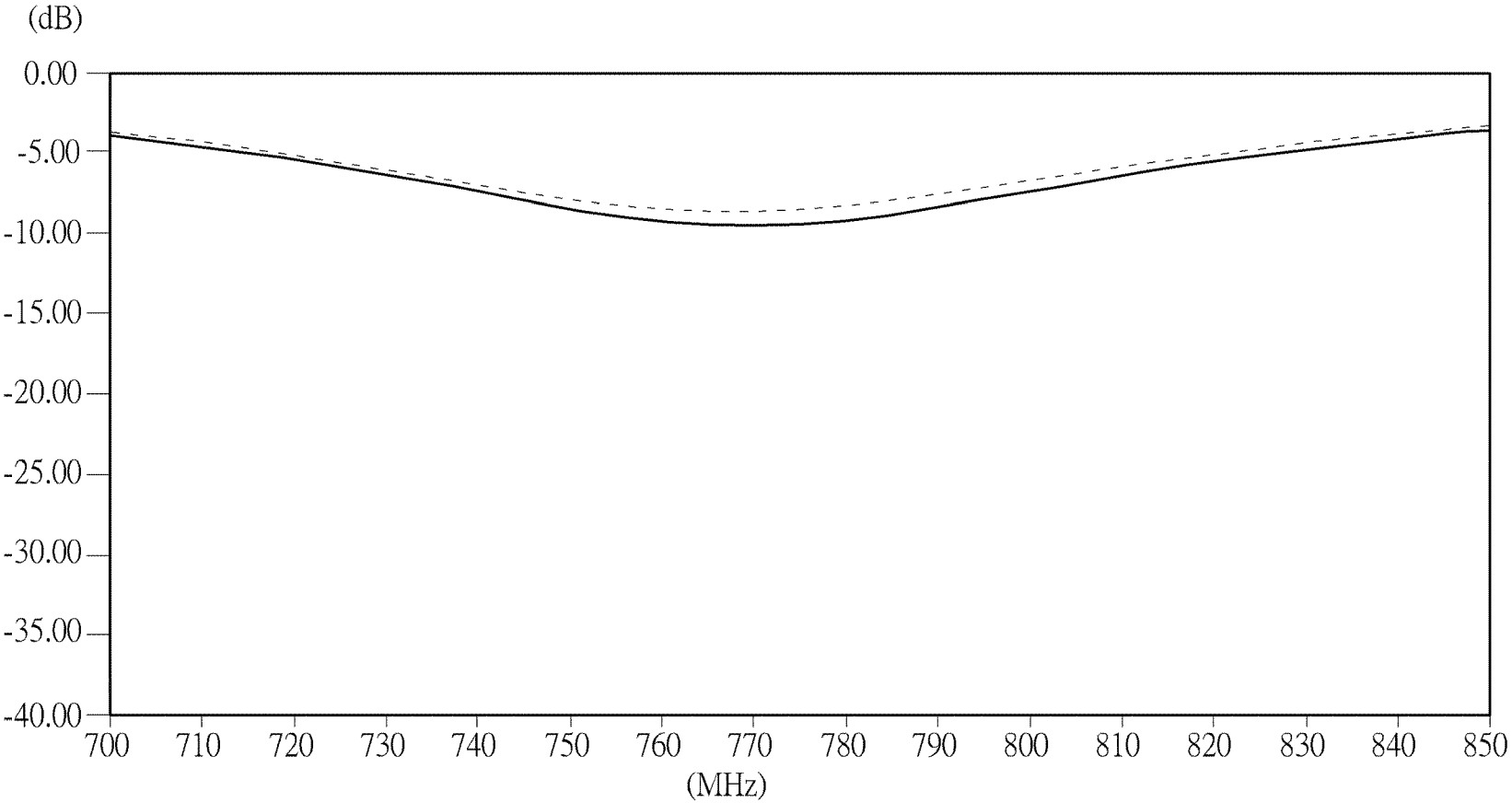
FIGS. 6A and 6B are schematic diagrams of the S-parameters of the antenna device operating in different bands shown in FIG. 5A.
Figure 6B:
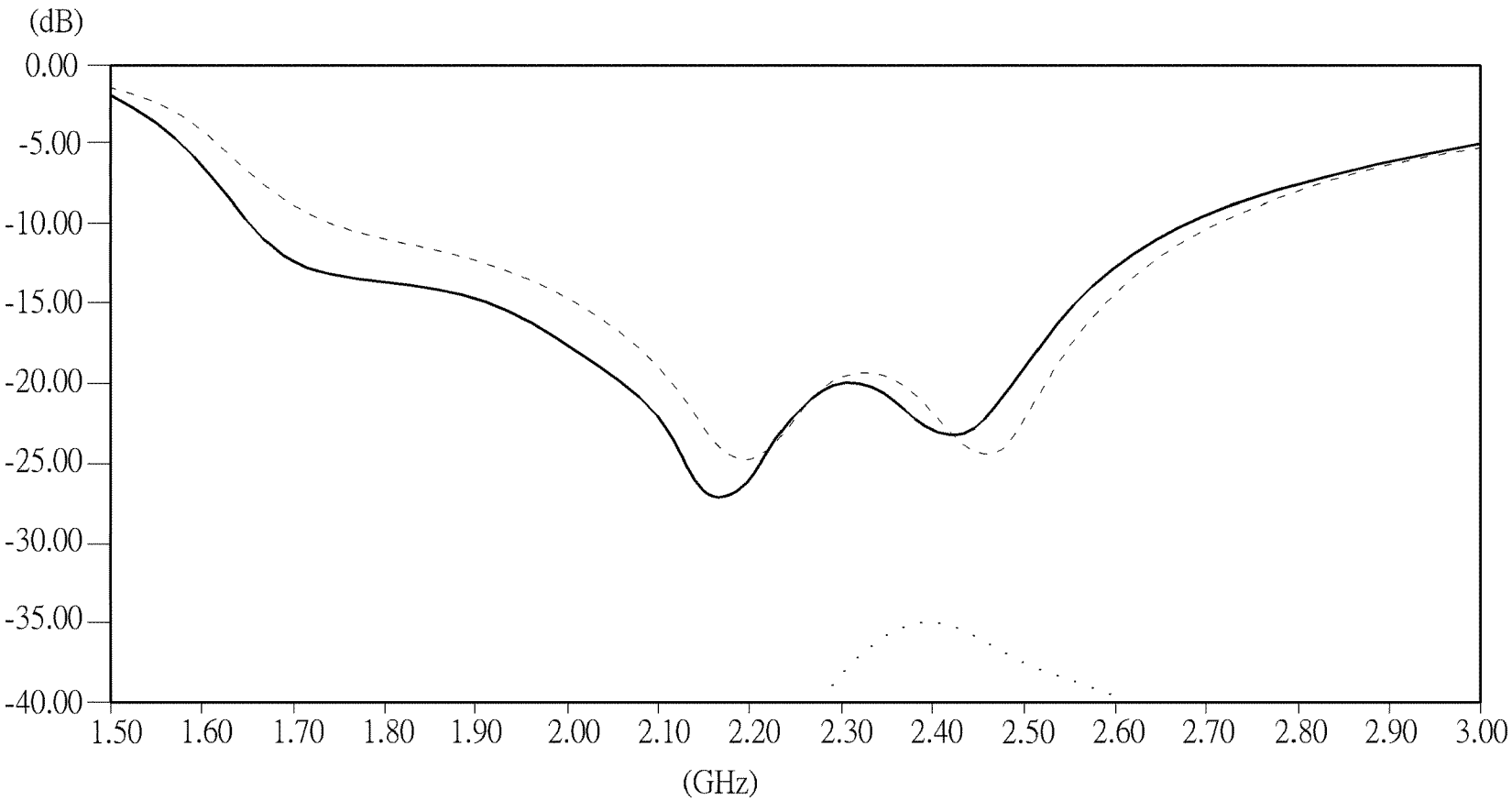
Figure 6C:
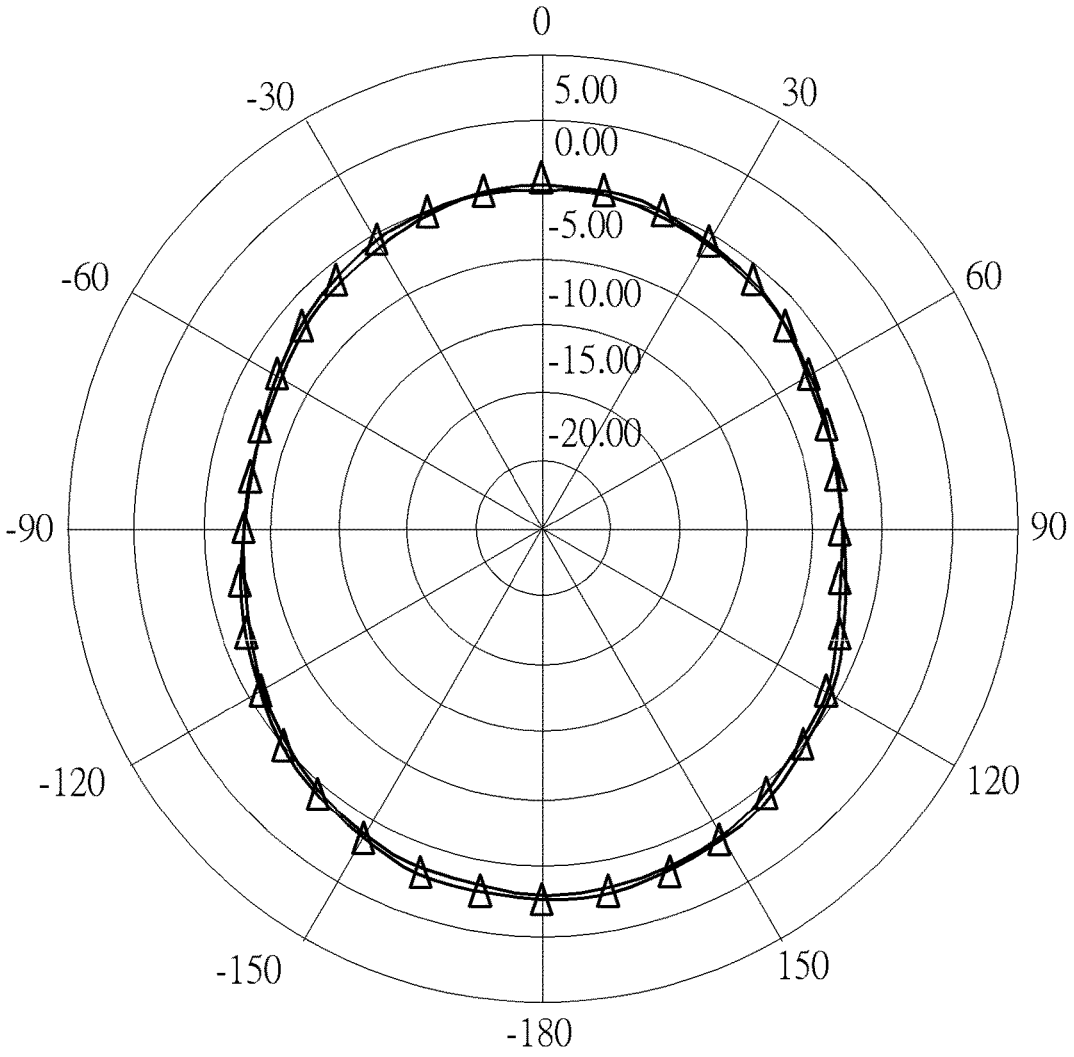
FIGS. 6C to 6F are pattern simulation results of the antenna device operating in different bands shown in FIG. 5A.
Figure 6D:
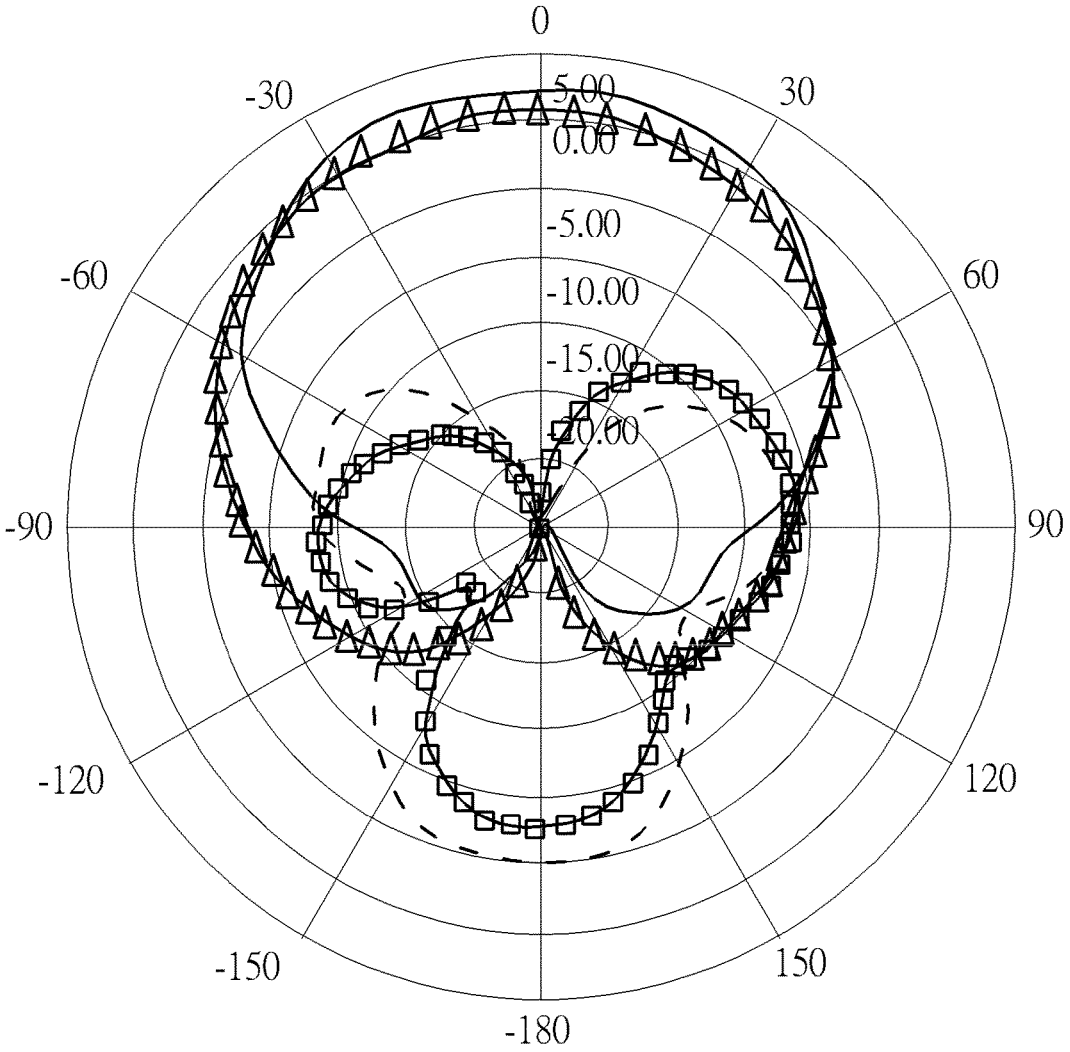
Figure 6E:
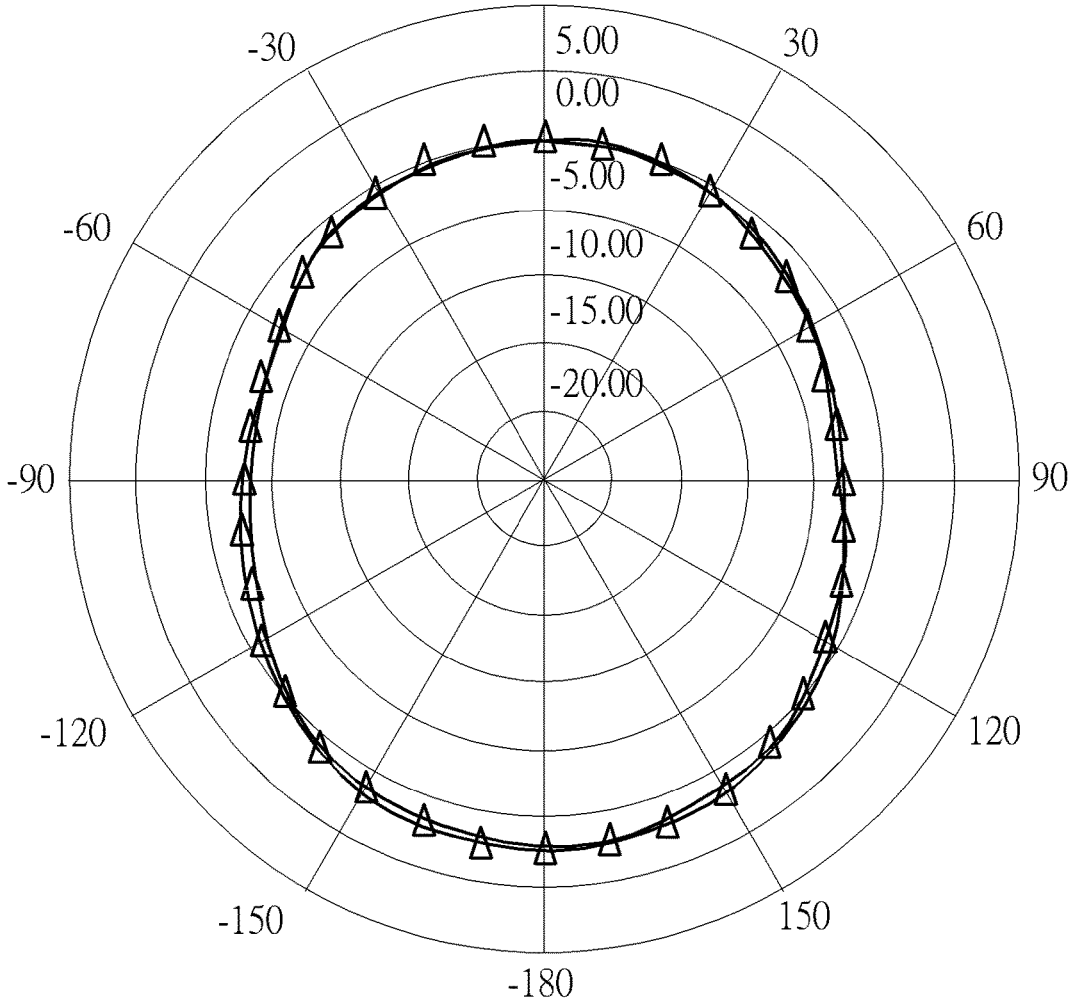
Figure 6F:
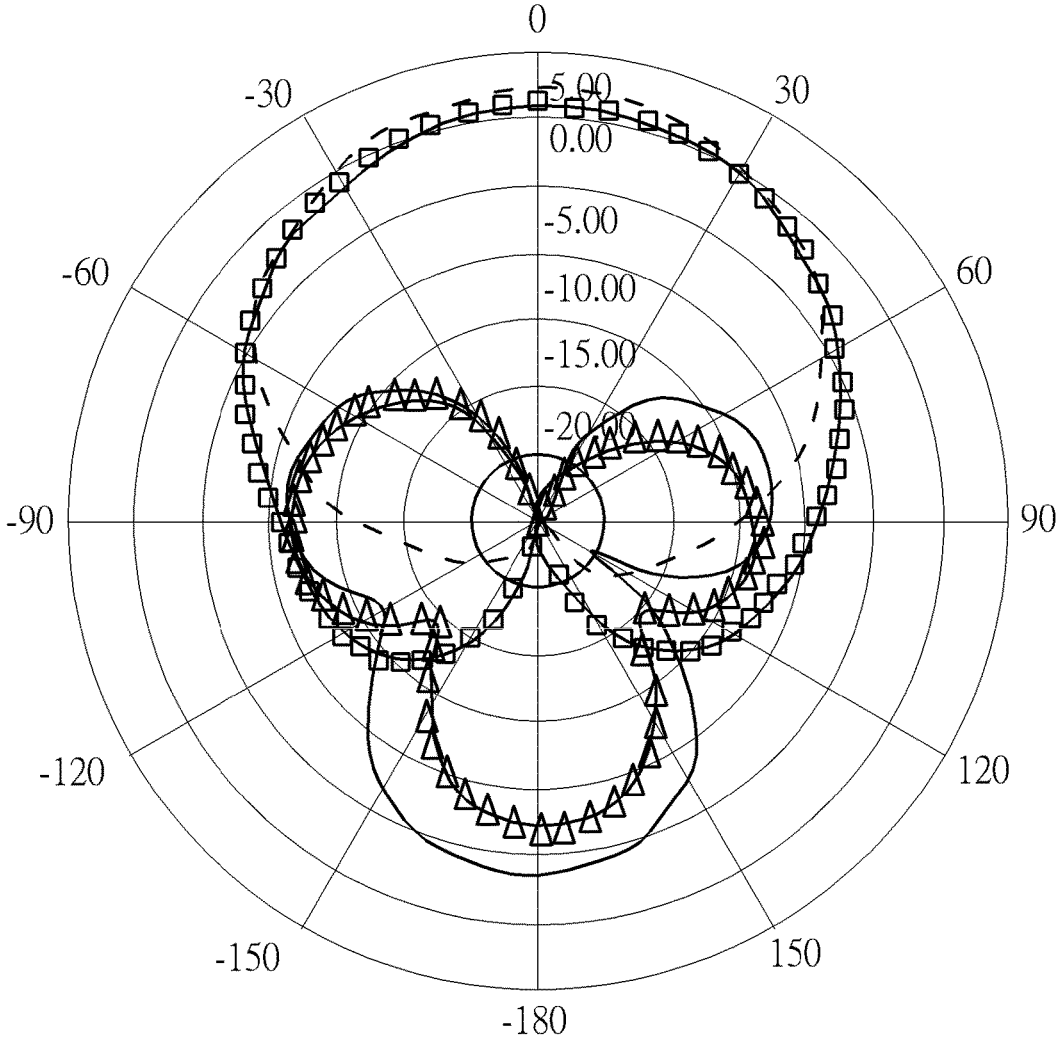

FIGS. 6A and 6B are schematic diagrams of S-parameters of the antenna device 50 operating in Band13 and Band4, wherein a solid-line curve represents the simulation result of the return loss (S11) of the first dipole antenna formed by the radiators RT1' and RT3', a dashed-line curve represents the simulation result of the return loss (S22) of the second dipole antenna formed by the radiators RT2' and RT4', and a dotted-line curve represents the simulation result of the transmission coefficient (i.e. S21, representing isolation) of the first dipole antenna relative to the second dipole antenna, where S21 is beyond the figure range of FIG. 6A and not shown. FIGS. 6C and 6D are pattern simulation results of the first dipole antenna operating in Band13 and Band4. In FIG. 6C, a solid-line curve represents the pattern of the first dipole antenna operating at 750 MHz in Band13, and a triangle-line curve represents the pattern of the first dipole antenna operating at 780 MHz in Band13. In FIG. 6D, a solid-line curve represents the Co-polarization pattern of the first dipole antenna operating at 1740 MHz in Band4, and a triangle-line curve represents the Co-polarization pattern of the first dipole antenna operating at 2140 MHz in Band4, a dashed-line curve represents the Cross-polarization pattern of the first dipole antenna operating at 1740 MHz in Band4, a square-line curve represents the Cross-polarization pattern of the first dipole antenna operating at 2140 MHz in Band4. FIGS. 6E and 6F are pattern simulation results of the second dipole antenna operating in Band13 and Band4. In FIG. 6E, a solid-line curve represents the pattern of the second dipole antenna operating at 750 MHz in Band13, and a triangle-line curve represents the pattern of the second dipole antenna operating at 780 MHz in Band13. In FIG. 6F, a dashed-line curve represents the Co-polarization pattern of the second dipole antenna operating at 1740 MHz in Band4, a square-line curve represents the Co-polarization pattern of the second dipole antenna operating at 2140 MHz in Band4, a solid-line curve represents the Cross-polarization pattern of the second dipole antenna operating at 1740 MHz in Band4, and a triangle-line curve represents the Cross-polarization pattern of the second dipole antenna operating at 2140 MHz in Band4.

As can be seen from FIGS. 6A and 6B, the antenna device 50 can accurately operate in Band13 and Band4, where the low-frequency impedance is around −7 dB, and isolation between the first dipole antenna and the second dipole antenna exceeds 30 dB, and even exceeds 40 dB in the low-frequency band, to ensure normal operations of the first dipole antenna and the second dipole antenna. As shown in FIGS. 6C to 6F, the first dipole antenna and the second dipole antenna are substantially omnidirectional in Band13 and directional in Band4. Meanwhile, the dual-band crossed-dipole antenna 500 has a gain drift around 5.5 dB in the low-frequency band, and the antenna gains of the first dipole antenna and the second dipole antenna are around 7 dBi within the range between 1710 MHz and 1755 MHz (i.e. the uplink band of Band4), while the antenna peak gain can reach 5.7 dBi within the range between 2110 MHz and 2155 MHz (i.e. the downlink band of Band4). Therefore, the antenna device 50 further improves the high-frequency antenna gain of the antenna device 10.

As can be seen, by changing the shapes of the radiators, the antenna device 50 not only operates as the antenna device 10, but also improves the high-frequency antenna gain to enhance antenna efficiency. Furthermore, in addition to changing the shapes of the radiators, auxiliary components may be added to meet the requirements of different systems. For example, the antenna gain of the antenna device 50 is increased by around 3 dB in the downlink band of Band4, but the antenna gains of the uplink band and the downlink band thereof are still different. In such a situation, a director may be added to the antenna device 50.

Figure 7A:
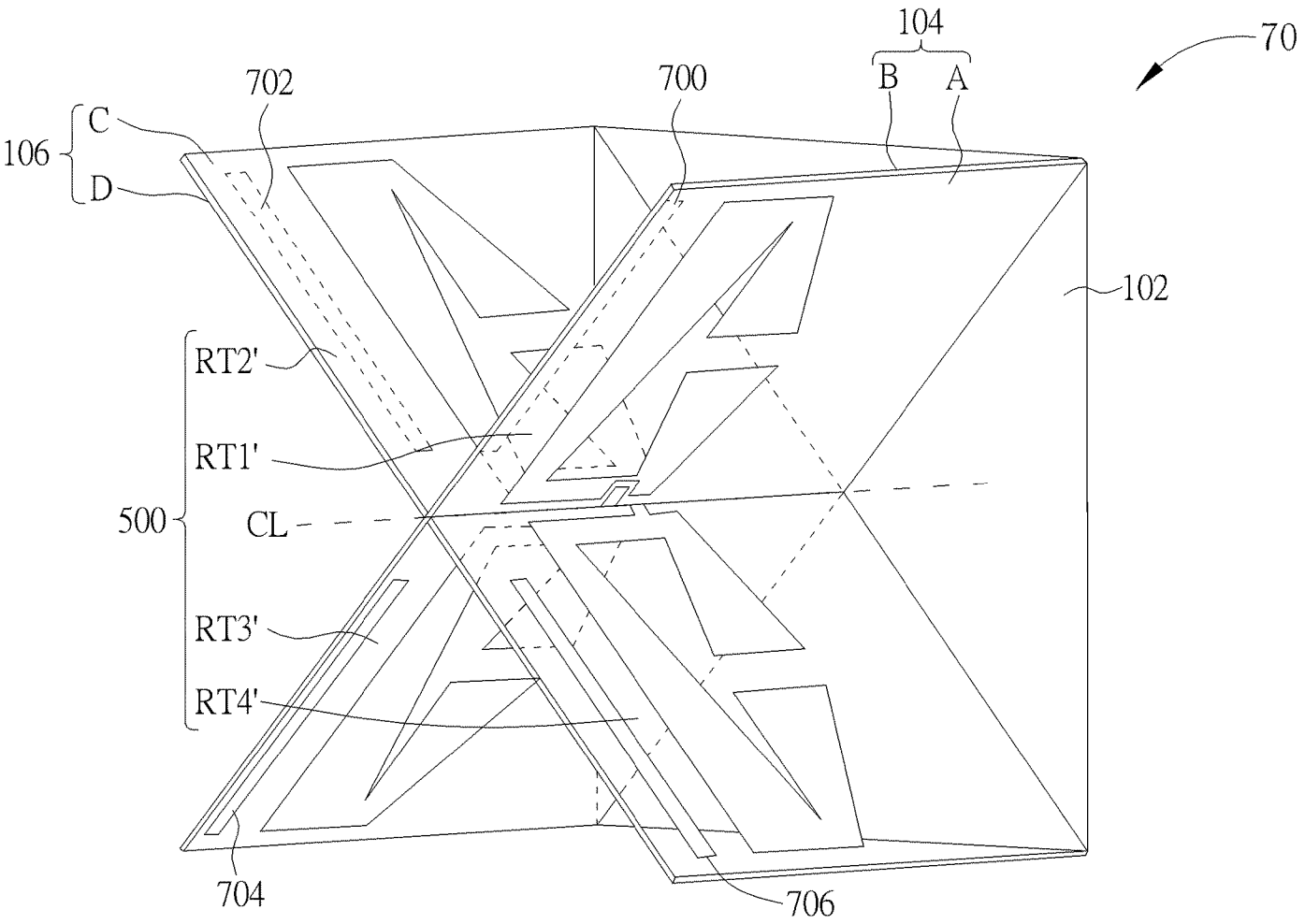
FIG. 7A is a schematic diagram of an antenna device according to an embodiment of the present invention.

FIG. 7A is a schematic diagram of an antenna device 70 according to an embodiment of the present invention. FIGS. 7B to 7E are schematic diagrams of components of the antenna device 70. The antenna device 70 is derived from the antenna device 10 of FIG. 1 and the antenna device 50 of FIG. 5A, and thus, the same components use the same notations. Different from the antenna device 50, directors 700, 702, 704 and 706 are added to form the antenna device 70. In addition, the antenna device 70 can similarly perform the dual-band operation (e.g. operations in a first band and a second band), and is substantially directional in the high-frequency band (i.e. the first band) and substantially omnidirectional in the low-frequency band (i.e. the second band).

Figures 7B, 7C, 7D, 7E:
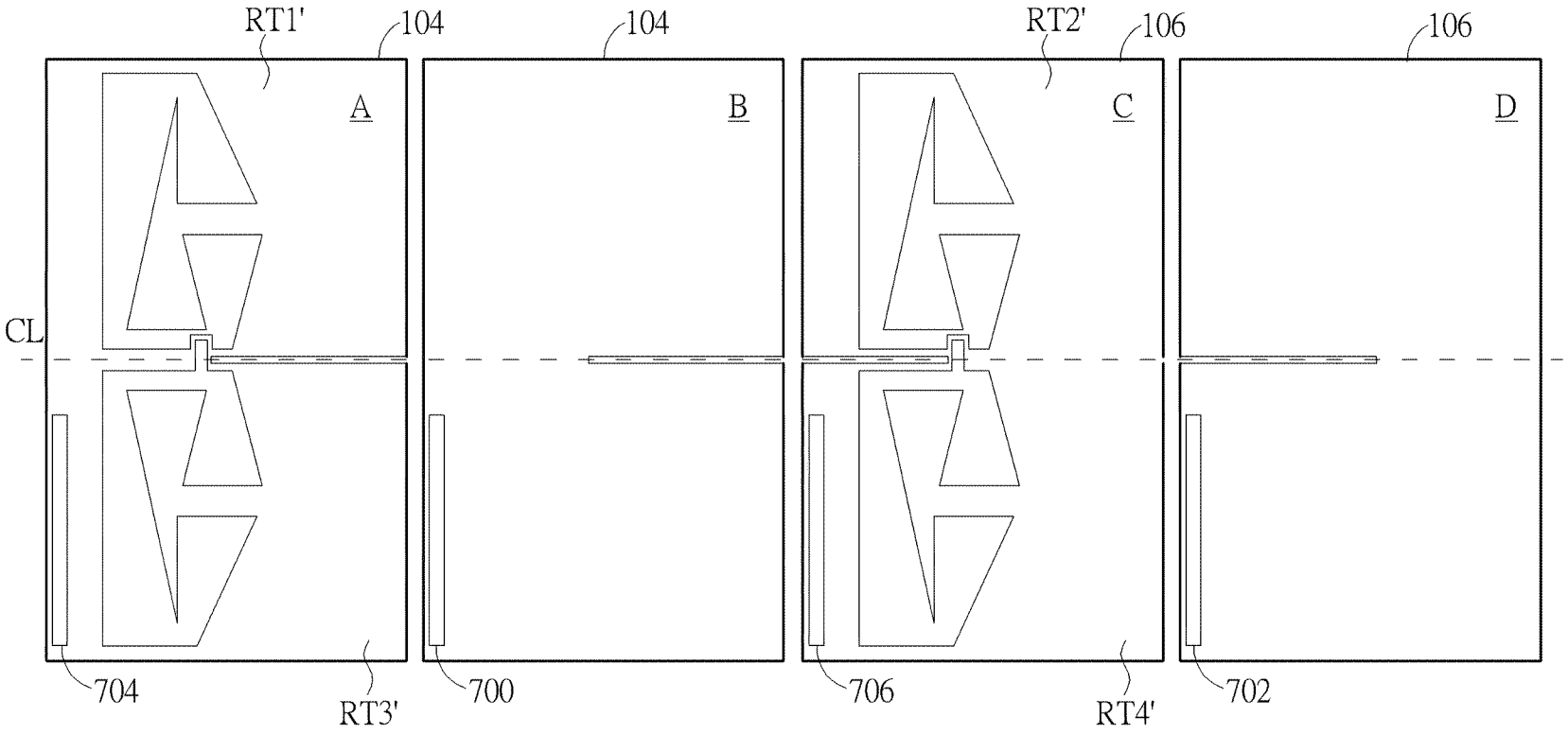
FIGS. 7B to 7E are schematic diagrams of components of the antenna device shown in FIG. 7A.

In detail, the directors 700, 702, 704 and 706 are disposed respectively on a "B" side of the base plate 104, a "D" side of the base plate 106, an "A" side of the base plate 104 and a "C" side of the base plate 106, and close to the edges of the radiators RT1'-RT4'. Notably, FIGS. 7C and 7E are front views of the "B" side of the base plate 104 and the "D" side of the base plate 106, where the relative positions between the directors 700, 702 and the radiators RT1'-RT2' may be known by further referring to FIG. 7A. In other words, the directors 700 and 704 are disposed on a front side and a back side of the base plate 104, and the directors 702 and 706 are disposed on a front side and a back side of the base plate 106. Such a disposition is for the convenience of assembly, but not limited to; for example, the directors 700 and 704 may be disposed on a same side of the base plate 104, or the directors 702 and 706 may be disposed on a same side of the base plate 106, where the disposed positions may be adjusted adequately. In addition, the lengths of the directors 700, 702, 704 and 706 are about half of the high-frequency (e.g. Band4 as mentioned in the above) signal wavelengths, and may be adequately adjusted—for example, the lengths of the directors 700, 702, 704 and 706 are greater than the length of the high-frequency path in this embodiment.

Figure 8A:
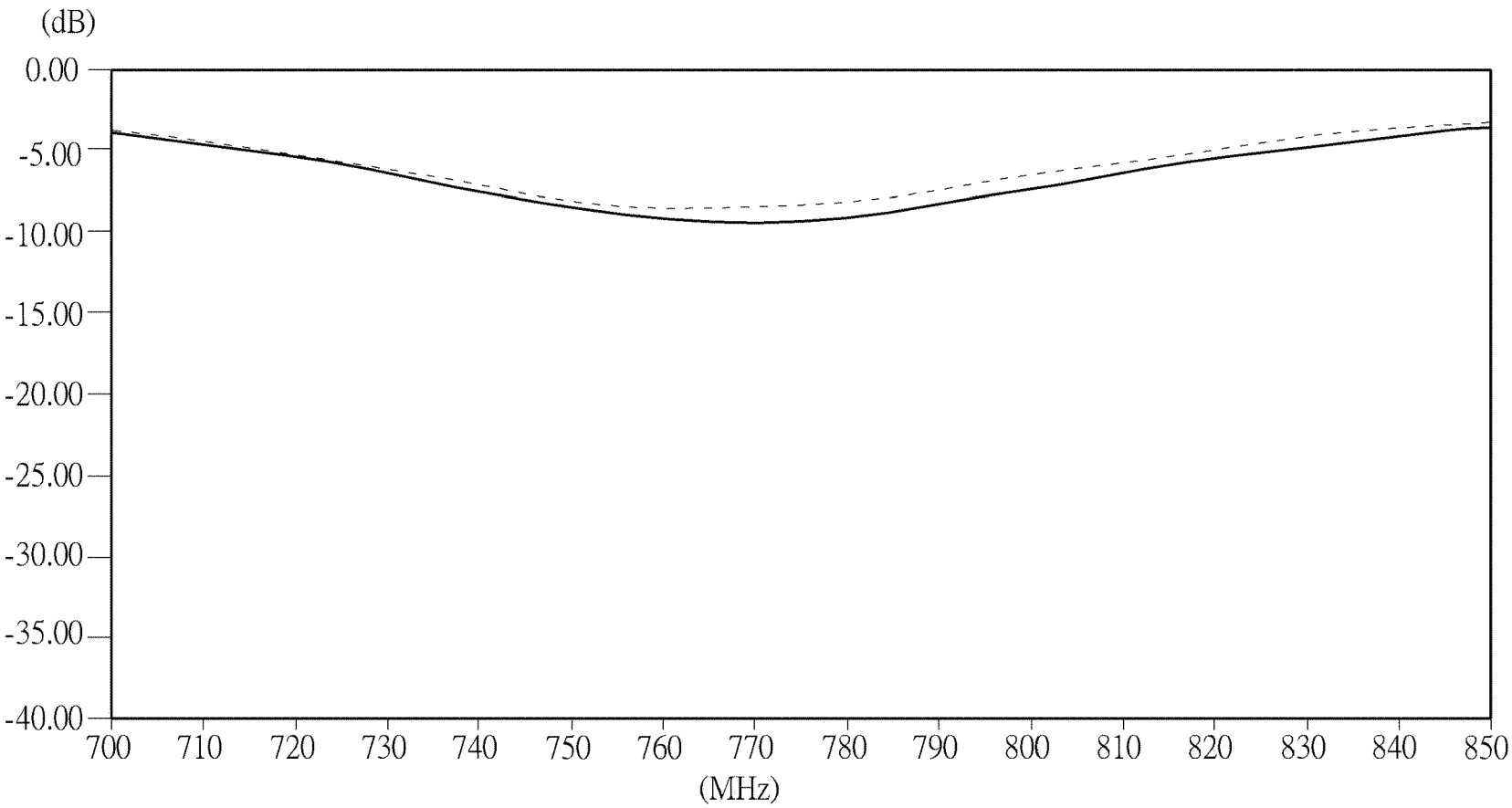
FIGS. 8A and 8B are schematic diagrams of the S-parameters of the antenna device operating in different bands shown in FIG.7A.
Figure 8B:
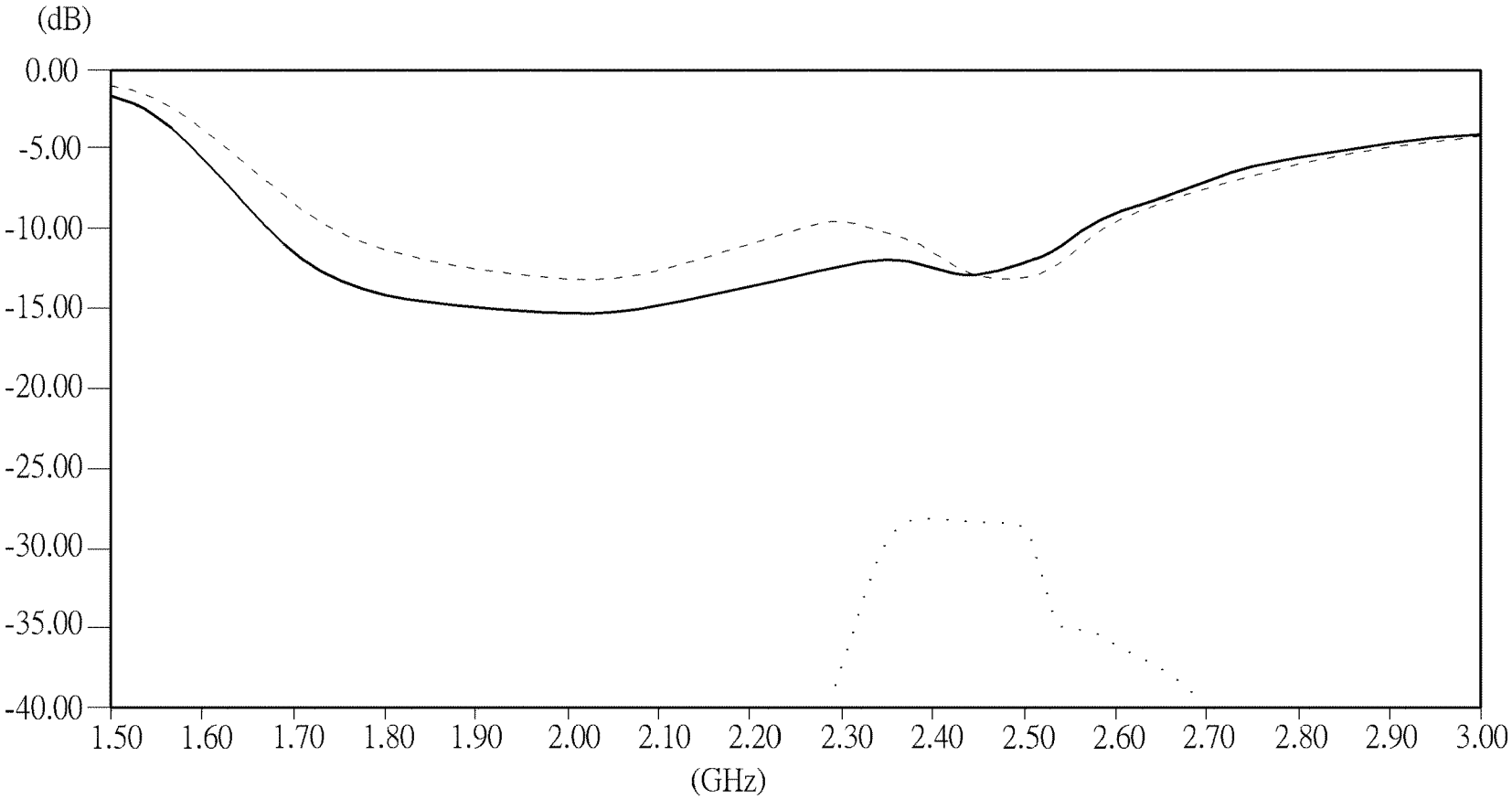
Figure 8C:
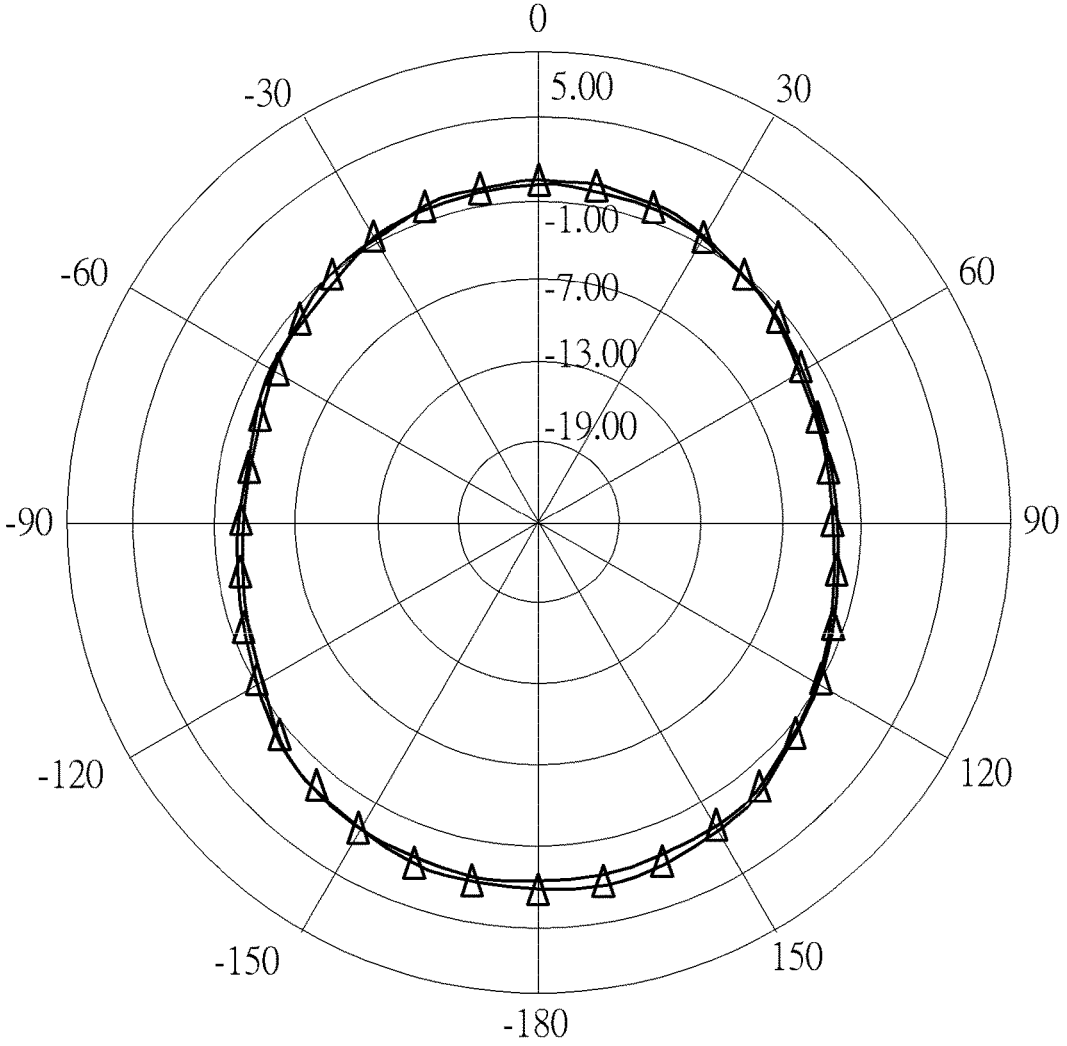
FIGS. 8C to 8F are pattern simulation results of the antenna device operating in different bands shown in FIG. 7A.
Figure 8D:
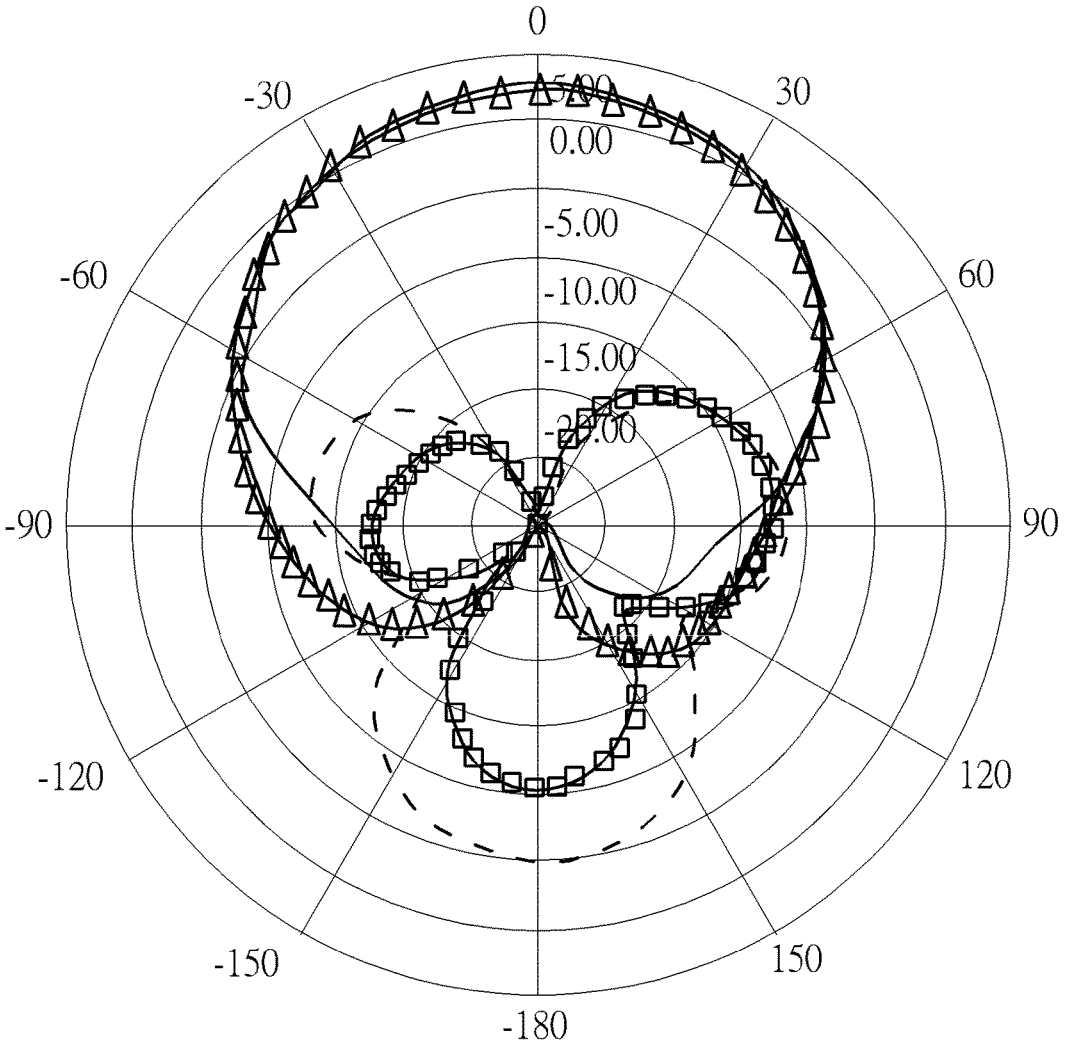
Figure 8E:
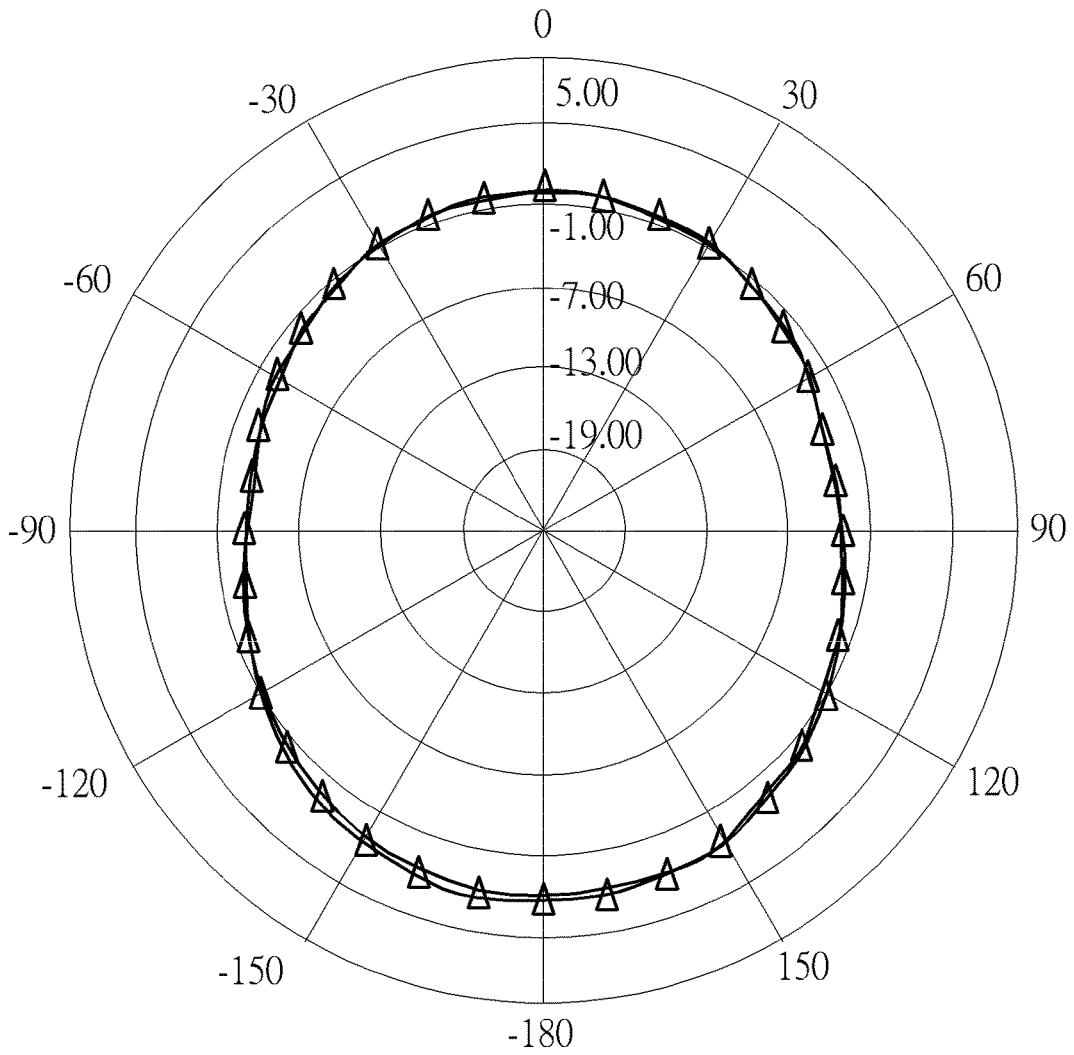
Figure 8F:
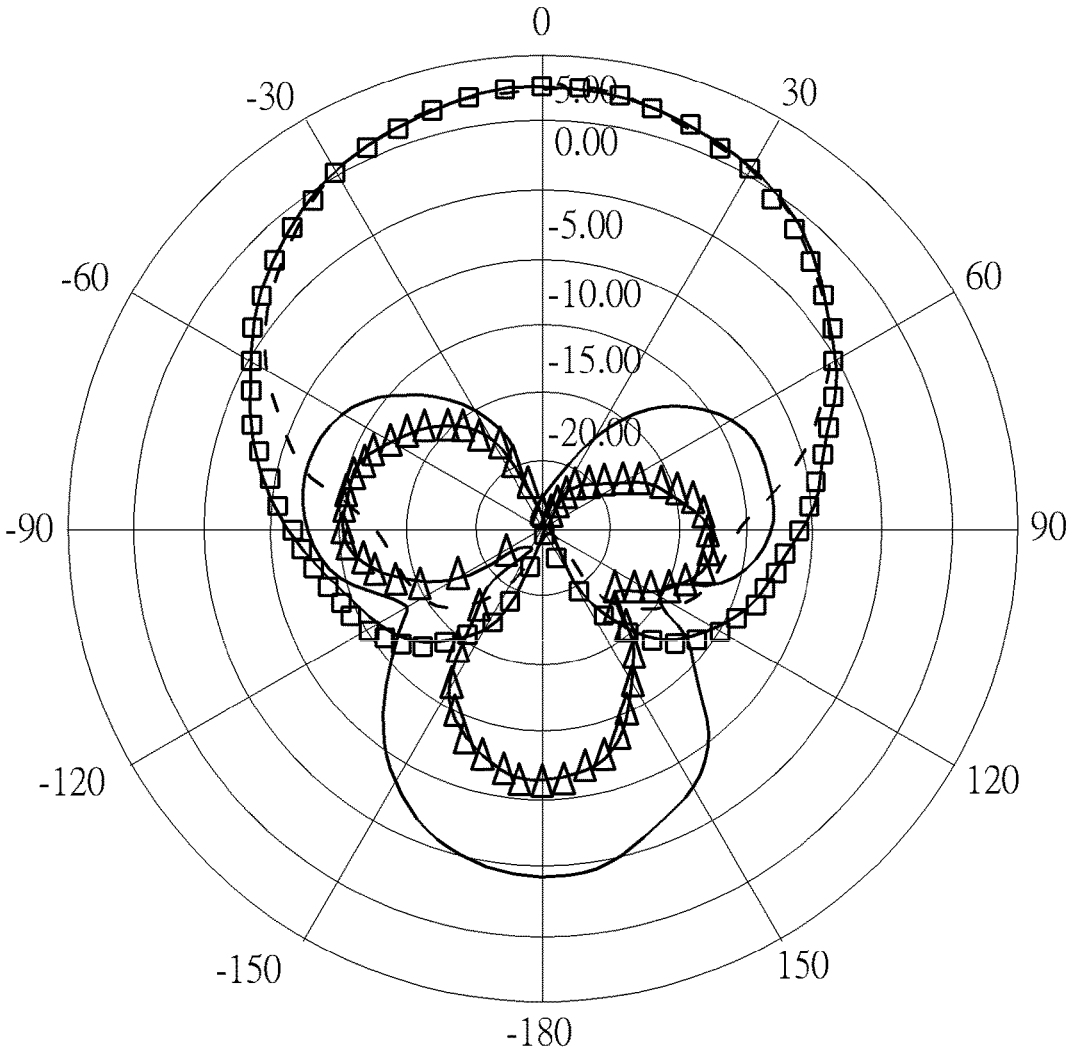

FIGS. 8A and 8B are schematic diagrams of the S-parameters of the antenna device 70 operating in Band13 and Band4, wherein a solid-line curve represents the simulation result of the return loss (S11) of the first dipole antenna formed by the radiators RT1' and RT3', a dashed-line curve represents the simulation result of the return loss (S22) of the second dipole antenna formed by the radiators RT2' and RT4', and a dotted-line curve represents the simulation result of the transmission coefficient (i.e. S21, representing isolation) of the first dipole antenna relative to the second dipole antenna, where S21 is beyond the figure range of FIG. 8A and not shown. FIGS. 8C and 8D are pattern simulation results of the first dipole antenna operating in Band13 and Band4. In FIG. 8C, a solid-line curve represents the pattern of the first dipole antenna operating at 750 MHz in Band13, and a triangle-line curve represents the pattern of the first dipole antenna operating at 780 MHz in Band13. In FIG. 8D, a solid-line curve represents the Co-polarization pattern of the first dipole antenna operating at 1740 MHz in Band4, and a triangle-line curve represents the Co-polarization pattern of the first dipole antenna operating at 2140 MHz in Band4, a dashed-line curve represents the Cross-polarization pattern of the first dipole antenna operating at 1740 MHz in Band4, a square-line curve represents the Cross-polarization pattern of the first dipole antenna operating at 2140 MHz in Band4. FIGS. 8E and 8F are pattern simulation results of the second dipole antenna operating in Band13 and Band4. In FIG. 8E, a solid-line curve represents the pattern of the second dipole antenna operating at 750 MHz in Band13, and a triangle-line curve represents the pattern of the second dipole antenna operating at 780 MHz in Band13. In FIG. 8F, a dashed-line curve represents the Co-polarization pattern of the second dipole antenna operating at 1740 MHz in Band4, a square-line curve represents the Co-polarization pattern of the second dipole antenna operating at 2140 MHz in Band4, a solid-line curve represents the Cross-polarization pattern of the second dipole antenna operating at 1740 MHz in Band4, and a triangle-line curve represents the Cross-polarization pattern of the second dipole antenna operating at 2140 MHz in Band4.

As can be seen from FIGS. 8A and 8B, the antenna device 70 can accurately operate in Band13 and Band4, where isolation between the first dipole antenna and the second dipole antenna exceeds 30 dB, and even exceeds 40 dB in the low-frequency band, to ensure normal operations of the first dipole antenna and the second dipole antenna. As shown in FIGS. 8C to 8F, the first crossed-dipole antenna and the second crossed-dipole antenna are substantially omnidirectional in Band13 and directional in Band4. More importantly, the antenna peak gains of the first dipole antenna and the second dipole antenna within the range between 1710 MHz and 1755 MHz (i.e. the uplink band of Band4) and the range between 2110 MHz and 2155 MHz (i.e. the downlink band of Band4) all exceeds 7 dBi. Therefore, compared to the antenna device 50, the antenna device 70 further improves the difference of the high-frequency antenna gains.

Figure 9C:
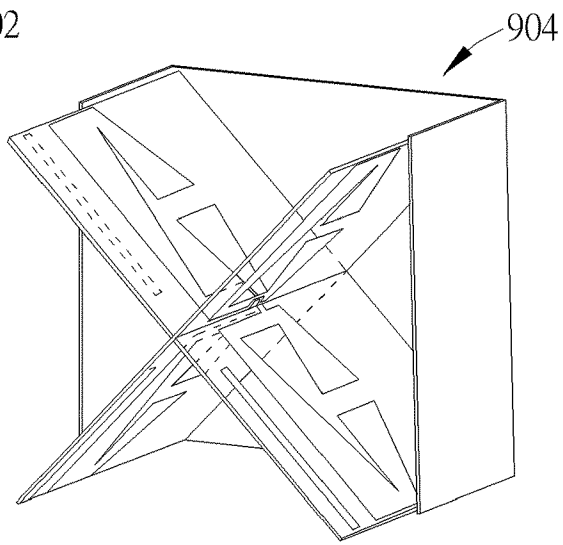
FIGS. 9A to 9H, 10A and 10B are schematic diagrams of antenna devices according to different embodiments of the present invention.
Figure 9B:
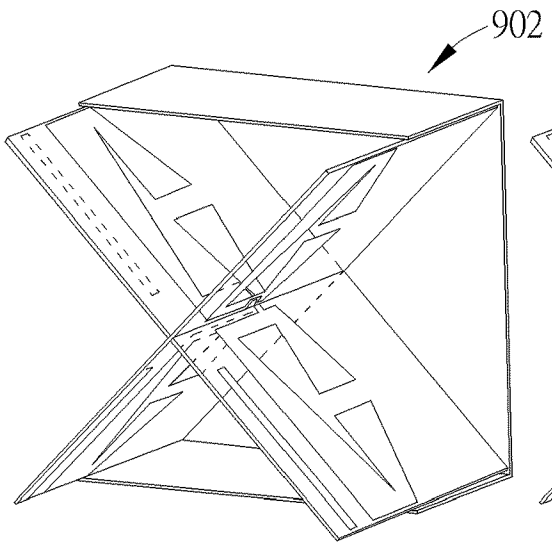
Figure 9A:
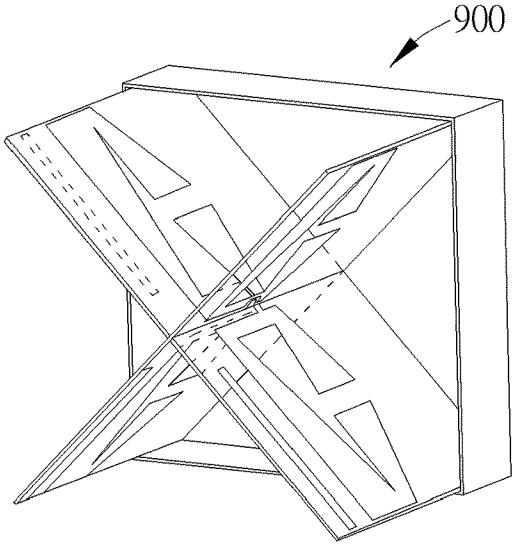
Figure 9E:
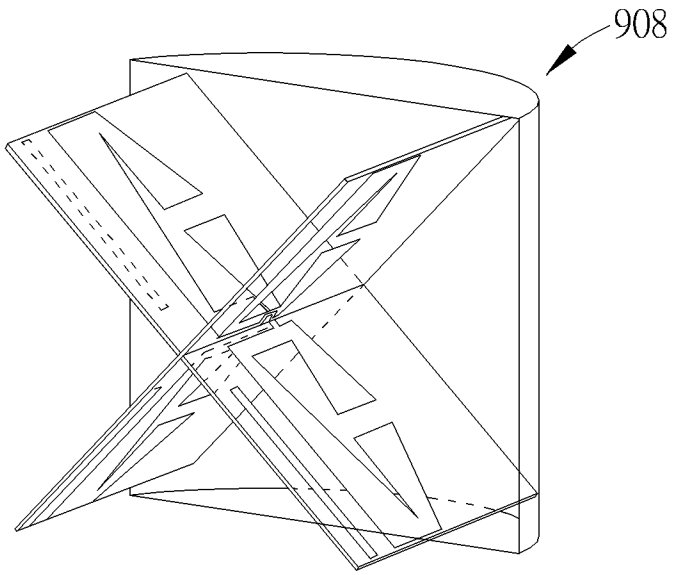
Figure 9D:
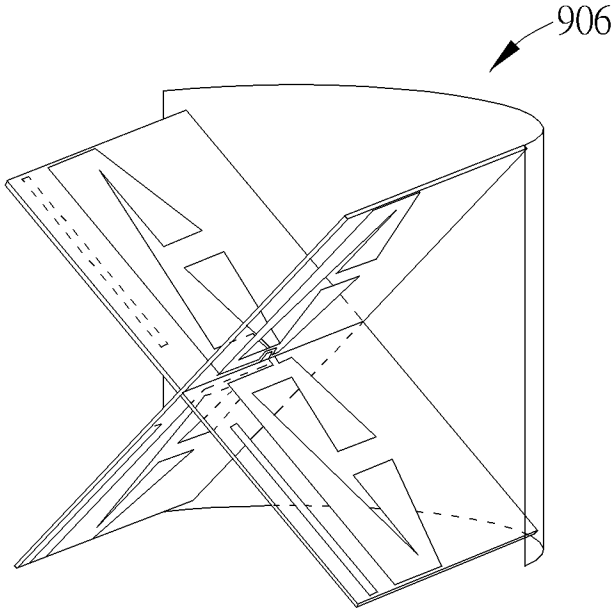
Figure 9H:
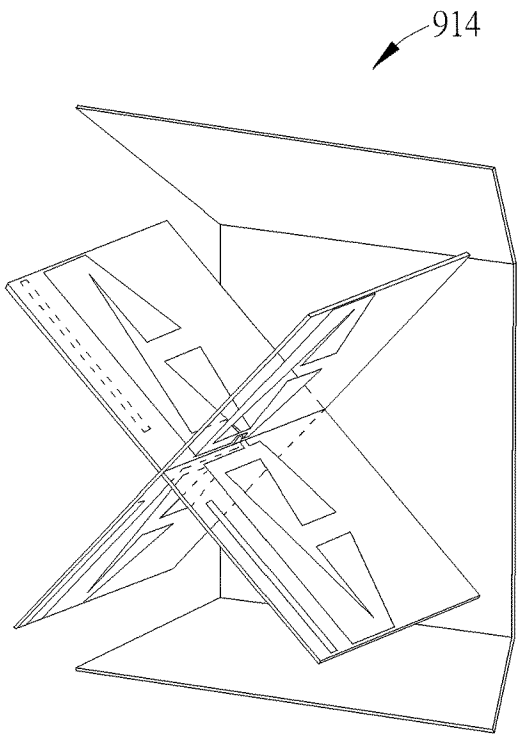
Figure 9G:
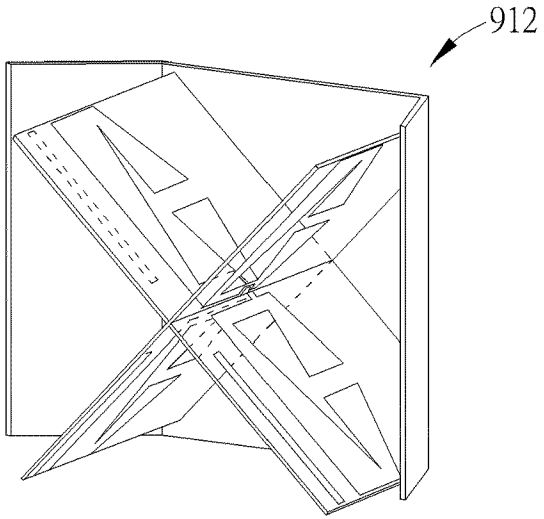
Figure 9F:
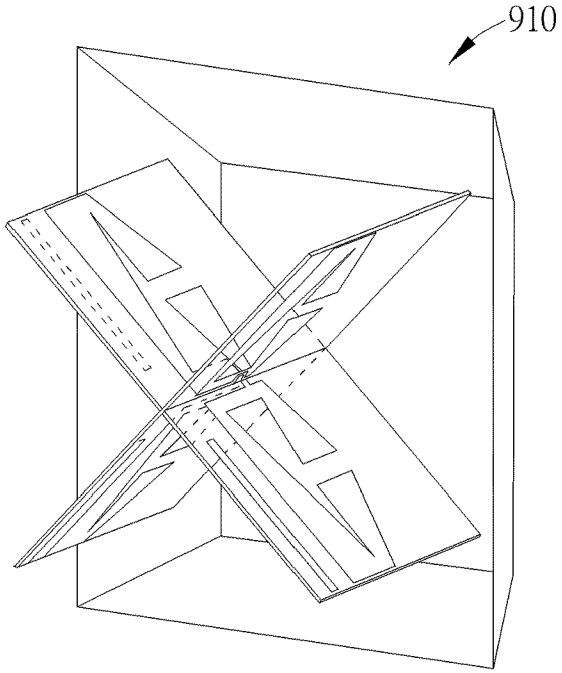

The antenna devices 50 and 70 are used to explain that the antenna device 10 may achieve different characteristics by changing the shapes of the radiators or adding the directors. However, the antenna devices 10, 50 and 70 are all capable of performing dual-band operation, and substantially directional in the high-frequency band and omnidirectional in the low-frequency band. Moreover, the aforementioned embodiments can be adjusted based on requirements of different systems, and not limited thereto. For example, FIGS. 9A to 9H are schematic diagrams of antenna devices 900, 902, 904, 906, 908, 910, 912 and 914 according to embodiments of the present invention. The antenna devices 900, 902, 904, 906, 908, 910, 912 and 914 are all derived from the antenna device 70 of FIG. 7A, where the differences lie in formats of the reflecting board of the antenna device 70. For simplicity, most of notations are omitted in FIGS. 9A to 9H. As shown in FIGS. 9A to 9C, four edges of the reflecting board of the antenna device 900 are vertically bended, and two opposite edges of the reflecting boards of the antenna devices 902 and 904 are vertically bended, such that each cross section of the reflecting boards of the antenna devices 900, 902 and 904 contains at least a bending. As can be seen from FIGS. 9D and 9E, the reflecting board of the antenna device 906 forms an arc, the reflecting board of the antenna device 908 forms an arc with two opposite edges bended; thus, each cross section of the reflecting boards of the antenna devices 906 and 908 contains at least an arc segment. As shown in FIGS. 9F, 9G and 9H, the reflecting board of the antenna device 910 forms a cavity and the dual-band crossed-dipole antenna of the antenna device 910 is substantially disposed in the cavity, and two opposite edges of the reflecting board of the antenna devices 912 and 914 are slantingly bended. The antenna devices 900, 902, 904, 906, 908, 910, 912 and 914 all meet the requirements of the present invention. In other words, as long as the projection result generated by projecting the reflecting board of the antenna device along the central axis (CL) on a reference plane is substantially a square and the projection result generated by projecting the dual-band crossed-dipole antenna along the central axis on the reference plane is substantially corresponding to two diagonals of the square, and a diagonal length of the reflecting board is set to be greater than 0.6 times of the signal wavelength corresponding to the high-frequency band and smaller than 0.35 times of the signal wavelength corresponding to the low-frequency band, and a nearest distance between the reflecting board and any of the high-frequency radiating elements is set to be between 0.15 to 0.25 times of the signal wavelength corresponding to the high-frequency band, the requirements of the present invention are met, wherein the above mentioned reference plane is perpendicular to a side of the central axis; for example, the plane where the reflecting board 102 is located in FIG. 1 can be seen as the reference plane.

Figure 10B:
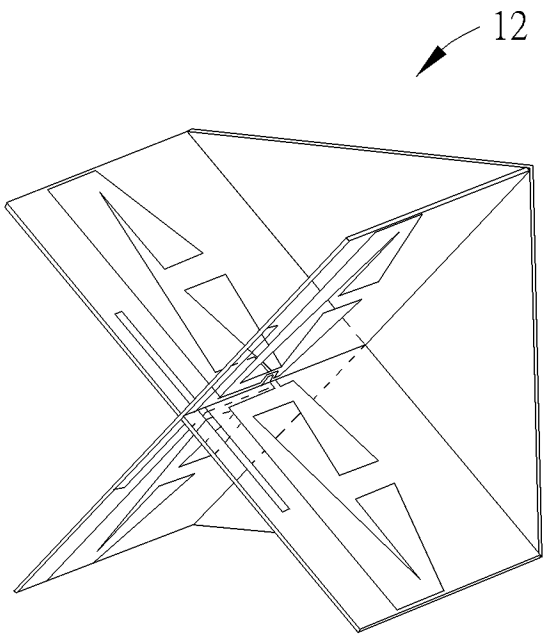
Figure 10A:
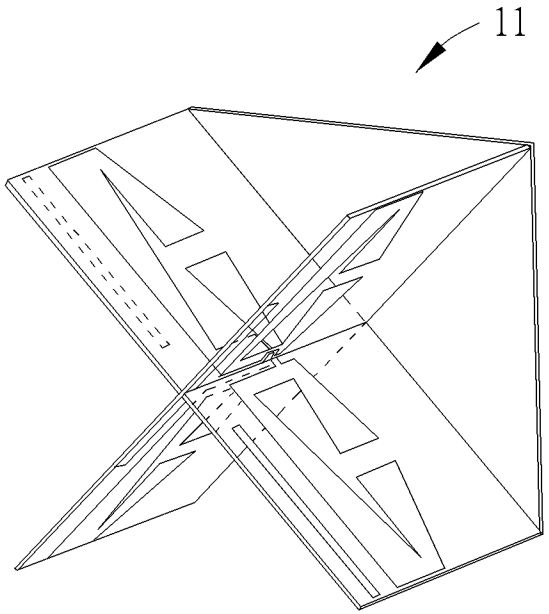

In addition, FIGS. 10A and 10B are schematic diagrams of antenna devices 11 and 12 according to embodiments of the present invention. The antenna devices 11 and 12 are both derived from the antenna device 70 in FIG. 7A, where the differences lie in formats of the directors of the antenna device 70. For simplicity, most of the notations are omitted. As shown in FIG. 10A, compared to the antenna device 70, a director of the antenna device 11 is modified as a single stripe, which extends from the central axis (CL) toward two sides, and another set of directors remain the same as the antenna device 70. In FIG. 10B, two directors of the antenna device 12 are modified to be extending from the central axis toward two sides. The antenna devices 11 and 12 are both capable of performing dual-band operation and substantially directional in the high-frequency band and omnidirectional in the low-frequency band.

In the prior art, usually combine duplexer with the high frequency antenna and the low frequency antenna as an antenna device to operate in the high/low-frequency bands. In contrast, the embodiment of the present invention does not need duplexer, but achieves an antenna device capable of operating in the high/low-frequency bands. More importantly, for applications which require to timely adjust the antenna angle or the directing position, such as indoor customer premises equipments, the antenna device of the present invention, if applied, can reduce and avoid the occurrences of dead zones and maintain the utilization of wireless transmission during the adjustment of the antenna angle or the directing position, because the antenna device 10 is omnidirectional in the low-frequency band.

In summary, the antennas devices of the embodiments of the present invention are capable of performing dual-band operation and substantially directional in the high-frequency band and substantially omnidirectional in the low-frequency band, and thereby improve the transmission efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna device, comprising:

a dual-band crossed-dipole antenna, comprising four radiators each extending from an axis toward a plane and comprising a first radiating element and a second radiating element for respectively transmitting or receiving radio signals of a first band and a second band, wherein a plane where each radiator is located is perpendicular to a plane where a neighboring radiator is located; and a reflecting board, disposed on a side of the dual-band crossed-dipole antenna;

wherein a first projection result generated by projecting the reflecting board along the central axis on a reference plane is substantially a square, and a second projection result generated by projecting the dual-band crossed-dipole antenna along the central axis on the reference plane is substantially corresponding to two diagonals of the square, wherein the reference plane is perpendicular to the central axis;

wherein a center frequency of the first band is higher than a center frequency of the second band, a diagonal length of the square of the first projection result is greater than 0.6 times of a signal wavelength corresponding to the first band and smaller than 0.35 times of a signal wavelength corresponding to the second band, a nearest distance between the reflecting board and any first radiating element of the four radiators is between 0.15 to 0.25 times of the signal wavelength corresponding to the first band, and the dual-band crossed-dipole antenna is substantially directional in the first band and omnidirectional in the second band.

2. The antenna device of claim 1, wherein a cross section of the reflecting board comprises at least a bending.

3. The antenna device of claim 1, wherein a cross section of the reflecting board comprises at least an arc segment.

4. The antenna device of claim 1, wherein the reflecting board forms a cavity and the dual-band crossed-dipole antenna is disposed inside the cavity.

5. The antenna device of claim 1, wherein each radiating element of the dual-band cross antenna comprises a director, for enhancing directivity of the dual-band crossed-dipole antenna on the first band.

6. The antenna device of claim 5, wherein the director of each radiator is parallel to the second radiating element, and a distance between the director and the second radiating element is smaller than a distance between the director and the first radiating element.

7. The antenna device of claim 5, wherein the director of each radiator extends on a first plane, and the first plane is identical to the plane extended by each radiating element.

8. The antenna device of claim 5, wherein the director of each radiator extends on a first plane, and the first plane is not identical to the plane extended by each radiating element.

9. The antenna device of claim 5, wherein a length of the director of each radiator is related to the first band.

* * * * *